US011098419B2

(12) United States Patent
Gabbay

(10) Patent No.: US 11,098,419 B2
(45) Date of Patent: Aug. 24, 2021

(54) MULTI-COMPONENT COMBINATION YARN SYSTEM FOR MOISTURE MANAGEMENT IN TEXTILES AND SYSTEM FOR PRODUCING SAME

(71) Applicant: ARGAMAN TECHNOLOGIES LTD., Jerusalem (IL)

(72) Inventor: Jeffrey S. Gabbay, Jerusalem (IL)

(73) Assignee: ARGAMAN TECHNOLOGIES LTD., Jerusalem (IL)

( * ) Notice: Subject to any disclaimer, the term of this patent is extended or adjusted under 35 U.S.C. 154(b) by 175 days.

(21) Appl. No.: 14/390,501

(22) PCT Filed: Apr. 2, 2013

(86) PCT No.: PCT/IL2013/050300
§ 371 (c)(1),
(2) Date: Oct. 3, 2014

(87) PCT Pub. No.: WO2013/150528
PCT Pub. Date: Oct. 10, 2013

(65) Prior Publication Data

US 2015/0038040 A1 Feb. 5, 2015

Related U.S. Application Data

(60) Provisional application No. 61/619,946, filed on Apr. 4, 2012.

(51) Int. Cl.
*D04B 21/16* (2006.01)
*D04B 1/16* (2006.01)
(Continued)

(52) U.S. Cl.
CPC ..... *D03D 15/33* (2021.01); *A41D 31/125* (2019.02); *D03D 15/43* (2021.01); *D04B 1/16* (2013.01);
(Continued)

(58) Field of Classification Search
CPC ..... D03D 15/0061; D03D 15/0094; D04B 21/16; D10B 2321/022; D10B 2401/021;
(Continued)

(56) References Cited

U.S. PATENT DOCUMENTS 4,307,152 A * 12/1981 Mathes ..... C07F 5/069 264/172.15
5,290,269 A * 3/1994 Heiman ..... A61F 5/485 604/372
(Continued)

FOREIGN PATENT DOCUMENTS

CN 101230514 A 7/2008
CN 101267937 A 9/2008
(Continued)

OTHER PUBLICATIONS

Rees, Herbert Catoen, Bruce. (2006). Selecting Injection Molds—Weighing Cost versus Productivity. Hanser Publishers.*
(Continued)

*Primary Examiner* — Jennifer A Gillett
(74) *Attorney, Agent, or Firm* — J.A. Lindeman & Co. PLLC

(57) ABSTRACT

The invention provides a thermal control combination yarn system including a first plurality of the yarns within the system including microdenier or almost microdenier hydrophobic yarns, such as, for example, polypropylene (PP) and a second plurality of the yarns including less hydrophobic ultra microfibers (UMF), wherein the first plurality of yarns is in direct contact with the second plurality of yarns. The yarn system can include from 97% yarns made of a microdenier or almost microdenier hydrophobic material and 3% yarns made of a less hydrophobic ultra microfibers (UMF) material to 97% yarns made of the less hydrophobic ultra
(Continued)

5UPP/50UMF blend- PP side at 0 time microfibers material and 3% yarns made of a microdenier or almost microdenier hydrophobic material.

13 Claims, 14 Drawing Sheets

(51) Int. Cl.
*A41D 31/12* (2019.01)
*D03D 15/33* (2021.01)
*D03D 15/43* (2021.01)

(52) U.S. Cl.
CPC ..... *D04B 21/16* (2013.01); *A41D 2400/10* (2013.01); *D10B 2321/022* (2013.01); *D10B 2401/021* (2013.01); *D10B 2403/011* (2013.01); *D10B 2403/0114* (2013.01); *D10B 2501/00* (2013.01); *D10B 2503/06* (2013.01); *Y10T 442/3065* (2015.04); *Y10T 442/425* (2015.04)

(58) Field of Classification Search
CPC ..... D10B 2403/011; D10B 2403/0114; D10B 2501/00; D10B 2503/06
USPC ..... 428/903, 339; 442/189, 301, 308, 346
See application file for complete search history.

(56) References Cited

U.S. PATENT DOCUMENTS 5,441,436 A * 8/1995 Moretz ..... A41B 9/004 2/73
5,508,098 A * 4/1996 Omar ..... B32B 5/26 442/319
5,906,876 A * 5/1999 Conway ..... A41B 17/00 428/88
6,427,493 B1 * 8/2002 Kasdan ..... D04B 1/16 66/169 R
6,432,504 B1 8/2002 Yeh
6,509,285 B1 * 1/2003 Yeh ..... D01D 5/082 442/195
7,217,456 B1 * 5/2007 Rock ..... D04B 1/24 428/367
2002/0098763 A1 * 7/2002 Yoshikawa ..... B32B 5/22 442/340
2003/0181118 A1 * 9/2003 Ko ..... B32B 5/26 442/335
2005/0101209 A1 * 5/2005 Li ..... D03D 1/0017 442/118
2006/0057350 A1 * 3/2006 Ochi ..... D01D 5/36 428/292.1
2007/0034278 A1 * 2/2007 Li ..... D03D 1/0017 139/383 A
2008/0096001 A1 * 4/2008 Emden ..... A41D 31/02 428/222
2009/0133446 A1 * 5/2009 Burrow ..... A61F 13/537 66/176
2009/0163099 A1 * 6/2009 Ackroyd ..... D03D 15/00 442/181
2009/0308107 A1 * 12/2009 Ogata ..... D02G 3/28 66/171
2010/0101744 A1 * 4/2010 Sawada ..... D21F 3/02 162/289
2010/0215895 A1 * 8/2010 Nadkarni ..... D01D 5/30 428/90
2010/0319409 A1 * 12/2010 Soeda ..... A41B 17/00 66/176

FOREIGN PATENT DOCUMENTS

CN 101798723 A 8/2010
CN 101864636 A 10/2010
DE 19547704 A1 6/1997
EP 1925231 A1 5/2008
EP 2174562 A1 4/2010
FR 2570935 A1 * 4/1986 ..... B32B 5/26
GB 2384789 A 8/2003
JP 05005215 A 1/1993
JP 05239716 A 9/1993
JP 06041818 A 2/1994
JP 08311716 A 11/1996
JP 2004011032 A 1/2004
WO 02/088446 A1 11/2002
WO WO-2006120490 A1 * 11/2006 ..... A41D 31/00
WO 2012/096920 A2 7/2012
WO 2012/119106 A2 9/2012

OTHER PUBLICATIONS

Outdoor Apparel Guide. http://outersports.blogspot.com/2006/10/polypropylene-vs-polyester.html. Posted Oct. 2, 2006. Retrieved Oct. 3, 2010.*
Adjacent, Definition of Adjacent by Merriam-Webster, http://merriam-webster.com/dictionary/adjacent, retrieced Sep. 12, 2018.*
Spencer, David, Fundamentals and Advances in Knitting Technology, Elsevier Ltd., 1983, p. 131-145.*

* cited by examiner

Fig.1 100% COTTON at Zero time
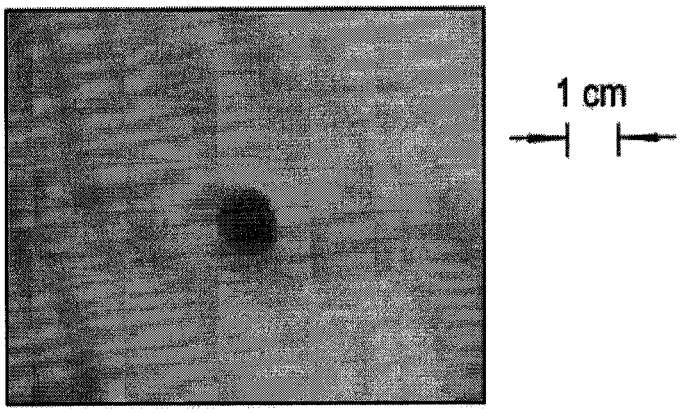
Fig.2 100% POLYESTER at Zero time
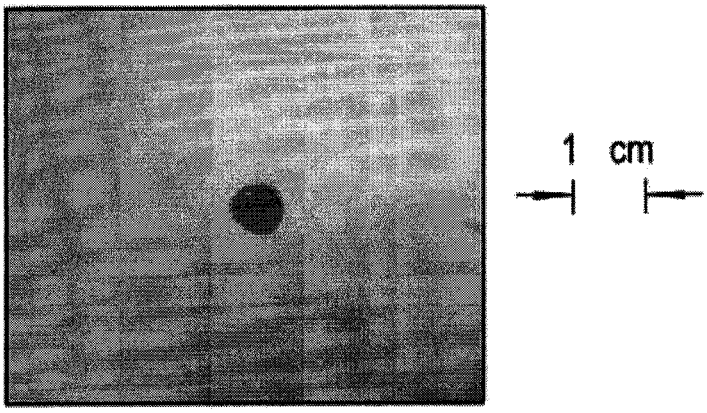
Fig.3 5UPP/50UMF blend- PP side at 0 time
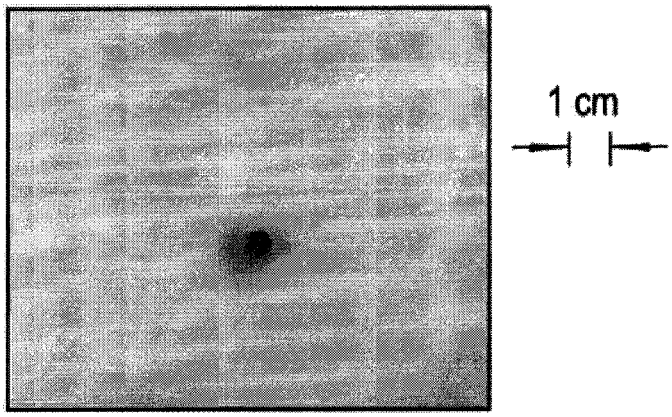

75PP/25UMF blend at 0 time

75PP/25UMF blend at 30 seconds

100% COTTON at 1minute

100% POLYESTER at 1 minute

75PP/25UMF blend at 1 minute

100% COTTON at 2 minutes

100% POLYESTER at 2 minutes

75PP/25UMF blend at 2 Minutes

100% COTTON at 3 minutes

100% POLYESTER at 3 minutes

75PP/25UMF blend at 3 minutes

100% COTTON at 5 minutes

100% POLYESTER at 5 minutes

75PP/25UMF blend at 5 minutes

100% COTTON at 10 minutes

100% POLYESTER at 10 minutes

75PP/25UMF blend at 10 minutes

100% COTTON reverse side at 20 minutes

100% POLYESTER at 20 minutes 1 cm

75PP/25UMF blend at 20 minutes 1 cm

75PP/25UMF blend at 20 minutes after push through 1 cm

UMF/50PP blend - PP side after push through

Fig.33
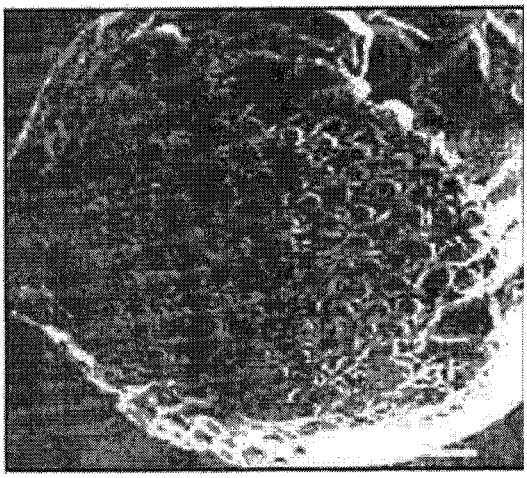
Before Splitting
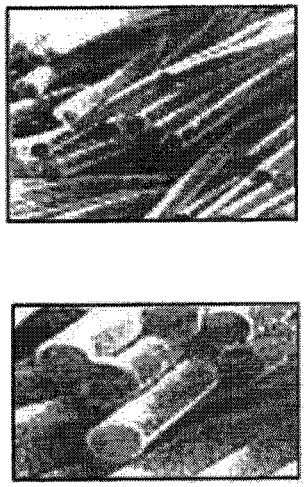
Split Fibers
Fig.34
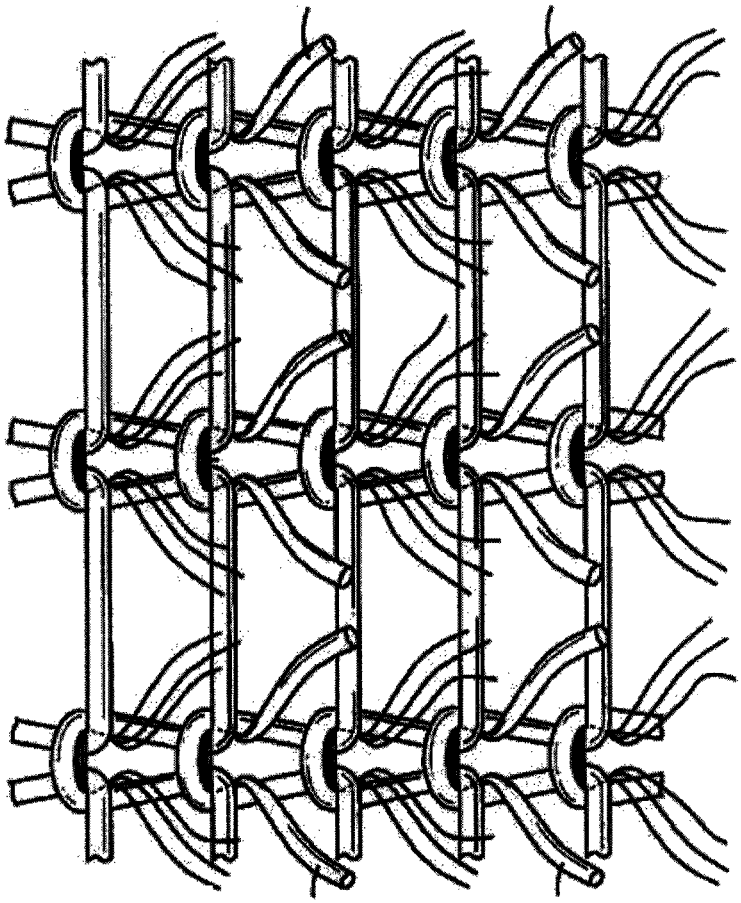

Fig.37
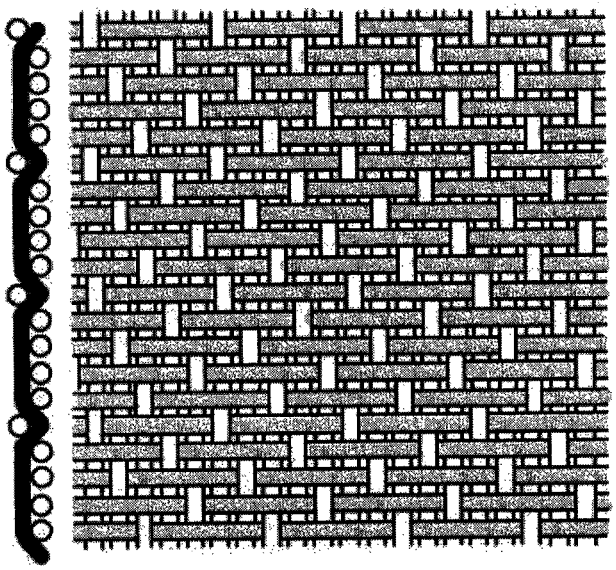
Fig.38
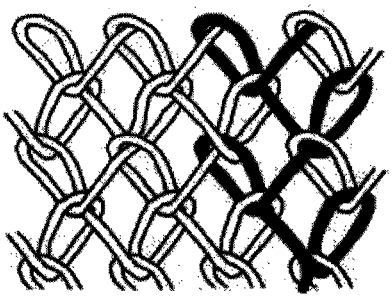
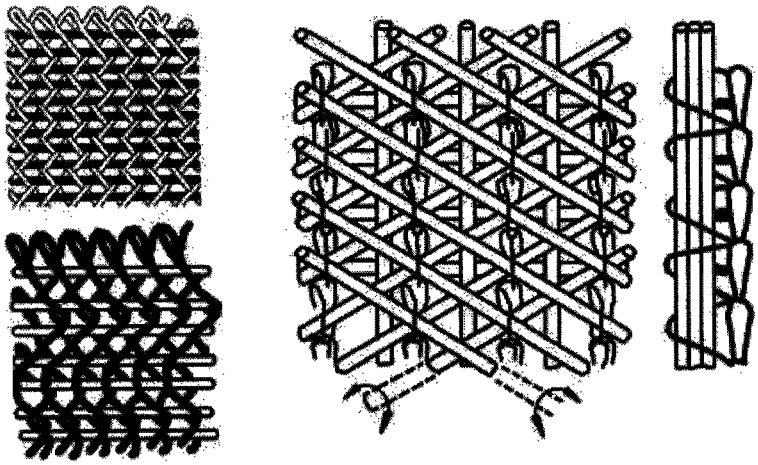

MULTI-COMPONENT COMBINATION YARN SYSTEM FOR MOISTURE MANAGEMENT IN TEXTILES AND SYSTEM FOR PRODUCING SAME

CROSS REFERENCE TO RELATED APPLICATIONS

The present application is a U.S. national phase of international application, No. PCT/IL2013/050300, filed Apr. 2, 2013, which claims the priority to U.S. Provisional Patent Application, No. 61/619,946, filed Apr. 4, 2012, the disclosures of which applications are hereby incorporated by reference.

BACKGROUND AND SUMMARY OF THE INVENTION

The present invention relates to yarn systems and multi-component textiles or fabrics, either woven or knit, incorporating the same, having enhanced moisture movement qualities which cause thermal regulation properties and methods for the manufacturing thereof. The multi-component fabrics comprise a combination of fibers which are classically used in alternative uses that enhance the wicking of water through the use of a surprisingly synergistic effect which causes an acute drop of temperature or a heat retention effect in fabric temperature under the correct conditions. While synthetic filament fibers are predominant in the field, a variety of staple fibers can also be used. The thermal regulation properties of the fabrics and garments of the present invention are caused by an extreme spreading of wicked waters on the fabric which, depending on which side of the fabric is close to the body, either evaporate quickly and thereby cool the textiles to a level hitherto unknown in the textile industry, or are trapped near the skin and help create an insulating layer, as in a scuba wet suit. Thus according to the present invention there has now been discovered a multi-component yarn system for a level of moisture movement along a single side of a two sided fabric which has been shown to produce an effect which is surprisingly greater than any Phase Transition Textile systems or other commercially available combination fibers using any synthetics fibers commonly used in the textile industry to date. When designed and used for cooling, the resulting fabric will move moisture from one side of the fabric to the other but more importantly will spread that moisture to an area larger than anything known to date for rapid evaporation. When used for insulation the resulting fabric according to the present invention, will trap body moisture near the skin as described hereinafter.

For the purpose of clarification a filament is defined as a fine or thinly extruded polymer strand which can be used as a yarn or which can form a yarn when many such strands are bundled and twisted together.

For the purpose of clarification a fiber is defined as a slender, elongated, threadlike object or structure often composed of many filaments as in most synthetic yarns.

For the purpose of clarification yarns are defined as a continuous strand of twisted fibers or filaments of natural or synthetic material, such as wool or nylon, polyester, polypropylene, etc., used in weaving or knitting.

Many fabrics are made from synthetic polymers. Conventionally, two processes are used to manufacture synthetic fibers: a solution spinning process and a melt spinning process. The solution spinning process is generally used for forming acrylic fibers, while the melt spinning process is generally used to form nylon fibers (PA), polyester fibers (PET), polypropylene (PP) fibers and other similar fibers. As is well known, a nylon (PA) fiber comprises a long chain synthetic polyamide (PA) polymer characterized by the presence of an amide group, a polyester (PET) fiber comprises a long chain synthetic polymer having at least 85% percent by weight of an ester of a substituted aromatic carboxylic acid unit, and a polypropylene (PP) fiber comprises a long chain synthetic crystalline polymer having at least 85% percent by weight of an olefin unit and typically having a number average molecular weight of about 40,000 or more.

The melt spinning process is of particular interest since a large portion of the synthetic fibers that are used in the textile industry are manufactured by this technique. The melt spinning process generally involves passing a molten polymeric material through a device that is known as a spinneret to thereby form a plurality of individual synthetic fibers. Once formed, the synthetic fibers may be collected into a strand or cut into staple fibers. Synthetic fibers can be used to make knitted, woven, or non-woven fabrics, or alternatively, synthetic fibers can be spun into a yarn to be used thereafter in a weaving or a knitting process to form a synthetic fabric. For the purpose of clarification the word microfiber (MF) refers to a fiber with less than 1 Decitex per filament (Source: Textile Terms and Definitions, 11th Edition, published The Textile Institute). Decitex is a measure of linear density and is commonly used to describe the size of a fiber or filament. Ten thousand meters of a 1-decitex fiber weighs one gram. Some commercial producers may use a value of less than 1.3 Decitex to define microfibers. Fibers are combined to create yarns which are knitted or woven in a variety of constructions. While many microfibers are made of polyester (PET), they can also be composed of but not restricted to polyamide (PA), polyolefins (PO), polypropylene (PP), or polyethylene (PE) as well as almost any extrudable polymer.

For the purpose of clarification extruded polymers are all hydrophobic. However, not all polymers have the same levels of hydrophobicity. By far the most hydrophobic fibers are the ones classified as isotactic which are polypropylene, polyethylene, and polyolefin. This is followed by polyester which is in turn followed by polyaramide. As is known to those familiar with the art a basic way of demonstrating hydrophobicity is by using the contact angle method. In this method, the level of hydrophobicity is measured by the angle of the side of a drop of water on a surface. The higher the number, the steeper the angle and therefore the more hydrophobic the substrate. Polypropylene has a contact angle of 102.1% while nylon has a 68.3% level and polyester has a 72.5% angle.

In some embodiments, this invention provides a thermal control combination yarn system comprising a first plurality of microdenier hydrophobic yarns wherein a preponderance of said first plurality of yarns is surface-exposed on a first surface of said system and comprising a second plurality of yarns comprising relatively less hydrophobic ultra microfibers (UMF) wherein a preponderance of said second plurality of yarns is surface-exposed on a second surface of said system and wherein said first plurality of yarns is in direct contact with said second plurality of yarns In some embodiments the hydrophobic polymers will have a contact angle of from 60% to 125%. In some embodiments the hydrophobic polymers will have a contact angle of from 80% to 125%, or in some embodiments, the hydrophobic polymers will have a contact angle of from 65% to 90%, or in some embodiments, the hydrophobic polymers will have a contact angle of from 60% to 100% or in some embodiments, the hydrophobic polymers will have a contact angle of from 85% to 120%.

For clarification it is demonstrated herein that the higher the hydrophobicity rating of the polymers used in the fibers of the products of this invention, the more effective the cooling or warming effect will be in the textile and garment as is explained herein.

The term "microdenier" refers to a filament fiber that has approximately 1 filament per denier. Generally this applies to polyester and polyaramide filament fibers. In the case of polypropylene the use of a microdenier configuration is not generally popular due to difficulties in production and then texturization. While in the preferred embodiment this invention uses a microdenier polypropylene as the preferred yarn, a similar but less effect can be obtained by using yarns with 2 denier per filament as well.

While the skilled artisan will appreciate what is intended by the phrase "Ultra MicroFibers" (UMF), in preferred embodiments, such term is to be understood to refer to synthetic filament fibers in which a microfiber is further split. The split can be in any number between 10 and 50 sub filaments to a single filament of a normal or micro denier filament but normally someone familiar with the art would expect to see no less than 10 filaments per denier in such a product. These yarns are typically not used in the apparel industry for a variety of reason and are generally made from more than one polymer such as nylon (PA) and polyester (PET) or polypropylene (PP) or a combination of different polymers and are used in mops and towels where high levels of moisture gathering is an advantage. Heretofore, UMF yarns have not been used in apparel because they will take in the water between the filaments and retain moisture in the spaces between the split filaments more than normal yarns unless the effect can be controlled as described herein in the present invention.

For the purpose of clarification it should be noted that polymer based fibers and filaments such as those mentioned here do not absorb water but rather gather and retain water between the filaments of the fiber. Unlike a cotton fiber which will absorb water and retain it in the cellular structure polymers cannot absorb water. Further it should be noted that all polymers such as PA, PET, PE, PO, PBT (Polybutylene terephthalate), or PP are hydrophobic in nature such being that some are more than others as described herein.

For the purpose of clarification different levels of different yarns in a textile matrix as described herein will produce either a cooling effect or warming effect. It has been found that the same fabric in a garment worn with the UMF on the outside surface of the garment will produce a a cooling effect can be reversed to a yield a warming effect. The level of the cooling and the level of the heating can also be controlled by varying different levels of the microdenier fiber yarns and the UMF yarns.

To control textile temperature or body temperature through the use of a fabric, what is prevalent in the industry is the use of micro-encapsulated materials that have phase change qualities such as various paraffins or chemistry such as polyglycol alcohol which is known for its ability to absorb and release heat.

Phase Change or Transition materials have been incorporated into mono-component acrylic fibers to provide enhanced reversible thermal properties to the fibers themselves as well as to fabrics made therefrom. This is readily accomplished, in part due to the high levels of volatile materials (e.g. solvents) typically associated with the solution spinning process of forming acrylic fibers. However, it is more problematic to incorporate phase change materials in hot melt spun synthetic fibers, since high levels of volatile materials typically are not present or desired in the melt spinning process. Previous attempts to incorporate phase change materials into melt spun synthetic fibers typically involved mixing microcapsules containing a phase change material with a standard fiber grade thermoplastic polymer to form a blend and subsequently melt-spinning this blend to form mono-component synthetic fibers. Such attempts generally led to inadequate dispersion of the microcapsules within the fibers, poor fiber properties, and poor processability, unless low concentration of the microcapsules were used. However, with low concentration of microcapsules, the designer enhanced reversible thermal properties normally associated with the use of phase change materials are difficult to realize. In order to bring the Phase Change Materials to a level which has meaning the most efficient application has been to topically apply the transition microcapsules.

JP05239716 entitled Thermally Insulating Conjugate Fiber discusses a thermoplastic fiber which controls a change in body temperature or outdoor temperature due to ceramic fine particles placed on the surface of the fibers for the purpose of insulation from solar rays.

JP06041818 entitled Endothermic and Exothermic Conjugate Fiber discusses a thermoplastic fiber which controls a change in body temperature or outdoor temperature due to the incorporation of a polyhexamethylene glutarate that covers the outside of the polymeric fiber.

JP08311716 entitled Endothermic and Exothermic Conjugate Fiber discusses a thermoplastic fiber which controls a change in body temperature or outdoor temperature due to a paraffin wax that covers the outside of the polymeric fiber.

JP05005215 entitled Endothermic and Exothermic Conjugate Fiber discusses a thermoplastic fiber which controls a change in the body temperature or outdoor temperature by coating one fiber with a second material such as a polytetramethylene adipate in varying weight ratios.

JP2004011032 entitled Temperature Control Fiber, and Temperature Control Fabric Member discusses a fiber made of a paraffinic hydrocarbon as a core of the fiber and a polyamide resin as a sheath.

The Gore Bike Wear Base Layer Shirt: "The mechanical push-pull effect, which is generated by combining an internal hydrophobic fiber with an external hydrophilic fiber, rapidly eliminates perspiration from the skin through the fabric. Rather than evaporation from the body, moisture evaporates via the external layer of the fabric. In this way, cooling due to evaporation is prevented and the fabric does not stick to the skin, thus improving performance." In the case of this garment there is a hydrophobic fiber and a hydrophilic fiber used in two layers. In the case of the technology referred to herein both yarns are hydrophobic. The mechanism for moisture movement is both the hydrophobic nature of the polypropylene but also the large surface area of the UMF fibers which are also hydrophobic. In the case of this shirt the outer layer is hydrophilic which will retain the water rather than transporting it which is different from the invention herein.

None of said patents teach or suggest a combination yarn system having enhanced thermal control properties as now disclosed and described herein, wherein the mechanism for the cooling or warming effect is based on management of moisture movement on the fabric surfaces (both top and bottom of the fabric) as well as the spread of the moisture along one or both sides of the fabric.

This invention provides a thermal control combination yarn system comprising a first plurality of yarns within said system comprising a micro denier hydrophobic material, having a preponderance of said first plurality of yarns being surface-exposed on a first surface of said system and a second plurality of yarns within said system comprising ultra microfibers (UMF) comprised of a second hydrophobic material with a surface area so great that its hydrophobic quality causes quick transportation of moisture along its fiber surface. The UMF are distinguished in this sense because as demonstrated in the attached figures the moisture movement effect is limited in microdenier yarns or in microdenier yarns treated with a surfactant to encourage water gathering into the fabric. In the UMF the surface area of the filaments is no less than 1/10 the size of a microdenier yarn and due to its greater surface area will allow for increased capillary activity and thus allow the moisture to be transported. When UMF are used in combination with microfibers the system for transportation of moisture is set in place as will be described and demonstrated herein. As is known to those familiar with the art the UMF fibers will reduce the weight of the water on its surface by spreading it thinly thus increasing capillary action which will speed up the evaporation process of the water and cool the surface of the textile.

In some embodiments, the ratio of said yarns to each other within said system range from between 97% yarns comprising a hydrophobic microdenier material and 3% yarns comprising ultra microfibers (UMF) which, as stated, are comprised of a large surface area hydrophobic material to 97% yarns comprising ultra microfibers and 3% yarns within said system comprising a microdenier material and said first plurality of yarns is in direct contact with said second plurality of yarns. In some embodiments, the microdenier yarns are comprised of polypropylene (PP).

The following is intended to describe what applicant believes is one mechanism that affords the cooling of the body and the warming of the body although there is no intention to be bound by this theoretical explanation.

In some embodiments, the ability of the described yarn systems to provide for body cooling may be attributable to the following: As the body heats from aerobic activity, water is secreted from the body, whose evaporation can cool the body. The pressure applied to the yarn system and potentially the fact that the hydrophobic layer of yarns repels any accumulated water, which in turn is expected to disrupt surface tension of the accumulated water, and ultimately allow for their interaction with underlying hydrophobic yarns The water has been found to wick away from the hydrophobic surface of the yarn system toward the second side of the yarn system where the UMF are in waiting. This, in turn can be arranged such that the water wicks away from the body and away from the side of the fabric touching the body, toward the surface distal to the body and exposed to air. The water and generated water vapor are attracted to and rapidly associate with the second side of the fabric where the yarns comprising UMF of a very high hydrophobic surface area material or materials when the UMF is made from more than one polymer are located. Due to the very high surface area of the UMF rapid evaporation of the mobilized fluid occurs.

Once a first path of transport though the base microdenier fiber layer has been established, subsequently pooled/pooling water and water vapor from the body may travel more rapidly along these established paths to the UMF resulting in still more rapid preferential fluid mobilization toward the UMF surface. This extreme movement is demonstrated in the figures attached. The further the moisture movement, the quicker will be the evaporation of the water from the UMF. As is known to someone familiar with the art, the quicker the evaporation, the cooler the area from which the water is evaporated. This evaporation is caused by the thinness of the spreading water and its exposure to the temperature of the wearer's body. The effect can be controlled by changing the composition of the fabrics, the thickness of the fabrics, and the positioning of the different yarns.

In some embodiments, when insulation or a warming effect is desired, then the orientation of the composite yarn systems of this invention may be expected to be varied in terms of which layer is proximal to the skin surface and which layers are distal to the skin surface and proximal to the extracorporeal environment.

In some embodiments, efficient warming is best achieved when the large surface area UMF containing layer is positioned proximally to the skin of the wearer. The UMF containing layer absorbs body vapor and the further insulation of the water-containing UMF layer by the proximally layer allows for the retention of the heat of the vapor. The mechanism is similar to that of a wet suit only in this case it is body vapor which is the primary insulating and warming material and not sea water.

Thus, in some embodiments, according to the present invention there is now provided a combination yarn system having enhanced thermal regulating properties wherein a first plurality of the yarns within said system comprise polypropylene (PP) and a second plurality of the yarns comprise UMF and wherein the ratio of said yarns to each other within said system range from between 97% PP and 3% UMF to 97% UMF and 3% PP and said first plurality of yarns is in direct contact with said second plurality of yarns. Thus, for example, thermal garments can be designed wherein a preponderance of UMF yarns are surface exposed on a first surface, which surface, for example most proximally located to the skin of the wearer of the garment and a preponderance of hydrophobic yarns are surface exposed on a second surface, which second surface is most distally located to the skin of the wearer of the garment.

In some embodiments, such yarn systems will be characterized by the presence of as much as 97% UMF and as little as 3% microdenier hydrophobic yarns, such as PP, preferably 10-50% UMF and 90-50% PP so that the fabric of the garment will gather in and retain water and water vapor and act much like a scuba wet suit which uses said water and vapor as an insulator. Alternatively, according to the present invention, active sportswear garments can be designed with yarns, such as polypropylene yarns, being preponderantly surface exposed on primarily the inside of the garment and UMF yarns being preponderantly surface exposed on the outside of the garment wherein the ratio of said yarns to each other within said system range from between 97%-3% UMF and 3%-97% hydrophobic yarns, such as and preferably with between 12 and 35% UMF and 88-65% microdenier hydrophobic yarns, such as water and water vapor will travel though the propylene layer from the body surface to the outside of the textile where the UMF yarns rapidly disperse the body moisture and facilitate its evaporation to facilitate keeping the body itself dry and the garment cool.

Thus the term having thermal control with reference to the combination yarn systems of this invention, in some embodiments, is intended to denote that the system, textiles, fabrics, garments etc of the present invention provide for the cooling or insulating/heating of the surface most proximal to the combination yarn system as herein described, as a function of the configuration and arrangement of the layers of the microdenier hydrophobic and UMF hydrophobic yarns contained therein. In some embodiments said proportions of different yarns can range from 10-90% hydrophobic UMF and 90-10% hydrophobic microdenier yarns such as PP of total fibers in the fabric or on either side of the fabric and wherein said different yarns are in direct contact with each other.

In some embodiments, when the thermal control combination yarn system is intended for the purpose of cooling the surface to which the system is applied, then the proportions of the yarns may range from 15%-40%, or in some embodiments, 10%-30%, or in some embodiments, 20%-45% of hydrophobic UMF yarns 12 and 60%-85%, or in some embodiments, 70%-90%, or in some embodiments, 55%-80%, or in some embodiments, 65%-88% hydrophobic microdenier yarns, such as polypropylene.

According to the present invention there is also now provided a textile formed from a combination yarn system as defined above wherein a first plurality of yarns within said system are made of microdenier hydrophobic yarn, for example, polypropylene, having at least 2 filaments per denier and a yarn thickness of between 15 and 400 denier and a second plurality of yarns within said system are made of hydrophobic UMF having at least 50 filaments per fiber, and a yarn thickness of between 15 and 400 denier.

According to the present invention there is now provided a thermal control textile comprising a combination yarn system as defined above, wherein a plurality of the yarns within said system comprise microdenier hydrophobic yarns, such as, for example, polypropylene (PP) and a plurality of the yarns comprise hydrophobic UMF and wherein said different yarns are in direct contact with each other.

In some embodiments, such microdenier hydrophobic yarns will have a water contact angle of more than 50.

In some preferred embodiments of the present invention there is provided a textile as defined above wherein said microdenier hydrophobic yarns, such as polypropylene yarns, being preponderantly surface exposed on primarily the inside of the textile and hydrophobic UMF yarns being preponderantly surface exposed on the outside of the textile.

In some preferred embodiments of the present invention there is provided a textile as defined above wherein said microdenier hydrophobic yarns, such as polypropylene yarns, being preponderantly surface exposed on primarily the outside of the textile and hydrophobic UMF yarns being preponderantly surface exposed on the inside of the textile.

In some embodiments of the present invention the textile is a knitted textile, and in some embodiments, the textile is a woven textile.

According to the present invention there is now also provided sheets and pillowcases and similar beddings characterized by the described thermal control properties comprising a combination yarn system as defined above wherein a plurality of the yarns within said system comprise hydrophobic yarns, such as, for example, polypropylene (PP) and a plurality of the yarns comprise ultra microfibers (UMF).

In some embodiments of the present invention there is provided a thermal control garment as herein described for use as active sportswear.

In preferred embodiments of the present invention there is provided a thermal control garment as herein described for use as thermal underwear or base layers.

In preferred embodiments of the present invention there is provided a thermal control garment as herein described for use to control hot flashes.

In preferred embodiments of the present invention there is provided a thermal control garment as herein described for control of fever in a child or adult.

In preferred embodiments of the present invention there is provided a thermal control garment as herein described for use in medical applications.

In some embodiments, the combination yarn system as defined above comprises a plurality of the yarns within said system comprise polypropylene (PP) and a plurality of the yarns comprise ultra microfibers (UMF).

In some embodiments, the combination yarn system as defined above is provided as sheets, pillowcases, blankets and similar bedding wherein a plurality of the yarns within said system comprise polypropylene (PP) and a plurality of the yarns comprise ultra microfibers (UMF).

In some embodiments, the combination yarn system as defined above is provided as an active sportswear garment as defined above wherein said polypropylene yarns are provided along the inner surface of said garment to come in contact with the skin of the wearer thereof and wick moisture from the surface thereof.

In some embodiments, the combination yarn system as defined above is provided as a thermal garment as defined above having enhanced insulating and thermal regulating properties wherein said UMF yarns are provided along the inner surface of said garment to come in contact with the skin of the wearer thereof.

In some embodiments of the present invention there is provided an active sportswear garment as defined above having enhanced cooling and thermal control properties wherein said polypropylene yarns are provided along the inner surface of said garment to come in contact with the skin of the wearer thereof and said UMF yarns are provided along the outer surface of said garment to disperse moisture wicked by said polypropylene yarns and facilitate the evaporation thereof.

This invention provides a thermal control combination yarn system comprising a first plurality of yarns within said system comprising a hydrophobic material, having a preponderance of said first plurality of yarns being surface-exposed on a first surface of said system and a second plurality of yarns within said system comprising ultra microfibers (UMF) comprised of a hydrophobic material or materials as described above.

In some embodiments, the ratio of said yarns to each other within said system range from between 97% microdenier hydrophobic yarns and 3% UMF material to 97% UMF material and 3% microdenier hydrophobic yarns and said first plurality of yarns is in direct contact with said second plurality of yarns. In some embodiments, the microdenier or 2 denier per filament hydrophobic yarns are comprised of polypropylene (PP).

In preferred embodiments of the present invention there is provided a thermal garment as defined above having enhanced insulating and thermal control properties wherein said UMF yarns are provided along the inner surface of said garment to come in contact with the skin of the wearer thereof to spread body moisture near the skin and help create an insulating layer and said polypropylene yarns are provided along the outer surface of said garment and serve to trap said insulating moisture along the surface of said UMF yarns.

In preferred embodiments of the present invention there are provided active sportswear garments as defined above wherein the ratio of said yarns to each other within said garment range between 10 and 50% UMF and 90-50% PP and wherein said PP yarns are preponderantly surface exposed on an inner surface of said garment and said UMF yarns are preponderantly surface exposed on an outer surface of said garment In preferred embodiments of the present invention there are provided active sportswear garments as defined above wherein the ratio of said yarns to each other within said garment range between 12 and 35% UMF and 88-65% PP and wherein said PP yarns are preponderantly surface exposed on an inner surface of said garment and said UMF yarns primarily are preponderantly surface exposed on an outer surface of said garment.

In some embodiments, the garments contemplated herein include exercisewear, including shirts, shorts, pants, shorts, exercise bras, and the like. In some embodiments, the garments contemplated herein are specifically designed for infant wear, and assist in overcoming the known poorer body temperature regulation in young infants. In some embodiments, the garments contemplated herein are specifically designed for use in a hospital setting where body temperature regulation is a critical factor in the treatment and well-being of various patients. In some embodiments, the garments contemplated herein are specifically designed for applications in treating hypothermia. In some embodiments, the garments contemplated herein are specifically designed for treating burn victims, where rapid cooling in a gentle light weight garment is particularly desirable.

In preferred embodiments of the present invention there is provided a combination yarn system as defined wherein said polypropylene is characterized by having been produced by a process comprising extrusion of approximate no less than 1 denier per filament and which optionally is then finished using a DTY (Draw Textured Yarn) system to add softness to the fiber.

In preferred embodiments of the present invention there is provided a combination yarn system as defined wherein said UMF is characterized by having been produced by a process comprising extrusion of no less than 2 denier per filament and subdivision into at least 8 micro-fibers.

In preferred embodiments of the present invention said are made from a combination of polyester (PET) and nylon (PA) fiber which fibers are co-extruded in a micro-fiber configuration.

In preferred embodiments of the present invention said UM fibers are made from a combination of polypropylene and polyester or polypropylene and nylon fibers which fibers are co-extruded in a micro-fiber configuration.

In preferred embodiments of the present invention said UMF can be made through co-extrusion and chemical separation of the sub-filaments.

In preferred embodiments of the present invention there is provide a combination yarn system as defined, comprising pairs of UMF yarn and PP yarn which are physically in close proximity to one another (as described hereinafter with reference to FIGS. 9 and 10). FIG. 9 shows a fabric comprised of 100% cotton, having a dye absorption of approximately 2.5-3 cm in 2 minutes, with the size of the stain being the same on either side. Similarly, FIG. 10 shows a fabric comprised of 100% polyester, and having a dye absorption of approximately 2.5 cm in 2 minutes, with the size of the stain being the same on either side.

In especially preferred embodiments of the present invention there is provide a combination yarn system as defined comprising pairs of two yarns twisted together, wherein one yarn is made from polypropylene (PP) and the second yarn in the twist is a filaments ultra micro yarn (UMF) made from a nylon (PA) core and polyester (PET) fibers (as described hereinafter with reference to FIG. 8).

In preferred embodiments of the present invention there is provide a combination yarn system as defined above comprising a plurality of yarns made from polypropylene (PP) and a plurality of UMF yarns, wherein a majority of said UMF containing yarns are each adjacent to at least two polypropylene (PP) containing yarns.

In especially preferred embodiments of the present invention there is provide a combination yarn system as defined above comprising a plurality of yarns made from polypropylene (PP) and a plurality of UMF yarns, wherein a majority of said UMF containing yarns are each adjacent to at least three polypropylene (PP) containing yarns.

The invention will now be described in connection with certain preferred embodiments with reference to the following illustrative figures and examples so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of one of the methods of the invention. In this regard, no attempt is made to show details of the invention in more detail than is necessary for a fundamental understanding of the invention, the description taken with the attached figures making apparent to those skilled in the art how the several forms of the invention may be embodied in practice.

BRIEF DESCRIPTION OF THE DRAWINGS

FIG. 1 is a photograph of 100% cotton fabric at 0 time. Absorption of dye is about 1 cm. The absorption was immediate and there was no treatment or surfactant on the fabric FIG. 2 is a photograph of 100% polyester fabric at 0 time. Absorption of dye is about 1 cm. The absorption was immediate since the fabric is treated with a surfactant that neutralizes the hydrophobic quality of the polyester yarns.

FIG. 3 is a photograph of the PP/UMF combination fabric with a drop of dye placed on the fabric surface at 0 time. In this case the drop is placed on the side of the fabric which is PP. There is no absorption of dye since no surfactant is being used which keeps the fabric highly hydrophobic. The drop will be absorbed into the fibers when the pressure or heat on the drop is greater than the adhesive pressure of the drop surface.

FIG. 33 is an SEM image of a Split Pie Ultra Microfiber, showing an "Island in the Sea" configuration of the Ultra-Micro Fiber.

FIG. 34 is Side View of a Knit Fabric Demonstrating a Top and Bottom to the Textile. Depending on the tightness of the knit the loops will be the dominant yarns on the outside of the fabric. Depending on whether one seeks a warming or cooling fabric this yarn can be changed from a PP to a UMF or the opposite.

FIG. 37 is a Typical 4×1 Woven Twill. The top side of the fabric is the side shown in the Figure. The white yarns show up as the dominant yarn in the Figure and are polypropylene. The black yarn is the UMF which is the background yarn.

FIG. 38 is Side View of Knits Demonstrating Two Levels.

DETAILED DESCRIPTION OF THE INVENTION AND EXAMPLES

Figure 4:
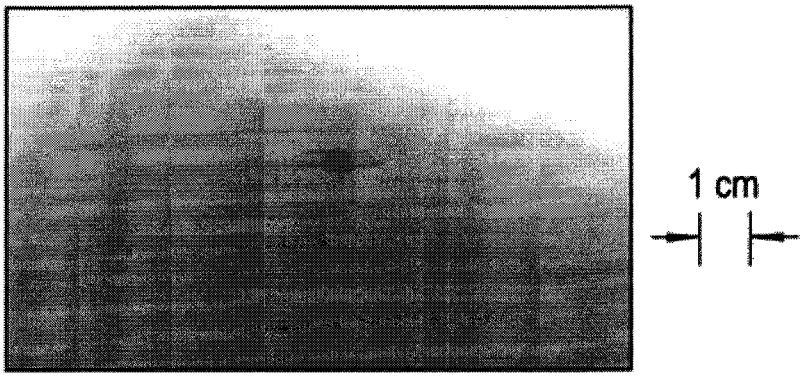
FIG. 4 is a photograph of the PP/UMF combination fabric with a drop of dye placed on the side of the UMF at 0 time. There is immediate initiation of absorption of the dye. Absorption of dye is about 2 cm at 0 time.

The primary positive physical characteristics of PP fibers for apparel applications are:

- Good bulk and cover, very lightweight (olefin fibers have the lowest specific gravity of all fibers)
- High strength (wet or dry)
- Resistant to deterioration from chemicals, mildew, insects, perspiration, rot and weather
- Abrasion resistant
- Low moisture absorption
- Stain and soil resistant
- Lowest static component of any man-made fiber
- Sunlight resistant
- Good washability, quick drying, unique wicking (moisture transport)
- Resilient, moldable, very comfortable
- Thermally bondable.
- Characteristics viewed as a drawback to the use of PP fibers for apparel applications are:
- Low melting temperature which prevents it from being ironed like cotton, wool, nylon etc.,
- Hard to be dyed after manufacturing, except after substantial treatment and modification, High crystallinity and poor thermal conductivity which leads to limited texturizability, i.e.; drawn polypropylene requires a contact time of 2 seconds in the heater compared to PET (POY) which requires only 0.4 seconds.

Poor UV and thermal stability which requires addition of expensive UV stabilizers and antioxidants to overcome this problem, Poor resilience compared to PET and Nylon, Creeping due to its low Tg(−15 to −20° C.), Poor adhesion to glues and latex, and Flammability characterized in that PP melts and burns like wax.

Probably the single characteristic that limits the use of PP fibers in the textile industry is the dry stiff nature of the fibers drawn from this polymer which is why its primary use in textiles is for cord, carpets, upholstery, and mattress tickings.

Many UMF are made from a combination of polyester (PET) and nylon (PA) fiber which is extruded in an ultra micro-fiber (UMF) configuration which can be seen in the SEM photos attached hereto as seen in FIG. 3. However, any polymer which can be extruded to yield a very high surface area can be used.

The key to the uniqueness of UMF is the very high level surface area.

Fiber Characteristics of polyester (PET) from which UMF can be made are as follows:

a. Strong
b. Resistant to stretching and shrinking
c. Resistant to most chemicals
d. Quick drying
e. Crisp and resilient when wet or dry
f Wrinkle resistant
g. Mildew resistant
h. Abrasion resistant
i. Retains heat-set pleats and creases
j. Easily washed The basic nylon (PA) fiber properties from which UMF can be made are described below:

1. Length: Length of a nylon (PA) filament is unlimited and staple fiber lengths are controllable.
2. Fineness: Nylon (PA) fiber fineness is also controllable.
3. X-sectional shape: Normally round shape but the cross sectional shape could be changed.
4. Strength of nylon (PA) fiber is very high. Its tenacity varies from 4.6 to 5.8 g/den.
5. Extensibility: Nylon (PA) is characterized by highly extensible fibers. Extension at break is 30% but the problem is poor recovery from extension. For that reason it is not used as a sewing thread for garments.
6. Resiliency: It has good resiliency properties. Nylon (PA) fibers, yarn or fabric do not crease easily. For that reason it is widely used for the pile fabric production. For instance velvet, carpet etc.
7. Frictional Resistance: Nylon (PA) fiber shows good frictional resistance. Due to high strength and its good frictional resistance property it is widely used for rope.
8. Moisture regain: moisture regain of nylon (PA) fiber varies from 4.2 to 5%. Nylon (PA) fiber does not absorb water easily. Water molecules can not enter into the inside of the fiber easily. For this reason nylon (PA) fabric can be dried easily. So it can be used as a raincoat.

Ultra Micro Fibers (UMF)

Very common in the textile industry are the use of microfibers (MF) but far less so the use of ultra microfibers (UMF) especially in apparel. They can take many forms such as a very fine filament made from one polymer, side by side configurations of one or more polymers, or concentric configurations of one or more polymers. In addition, they can be made a wide variety of polymers.

The polymers given below can be used as any part of UMF in a yarn either alone or together in a variety of configurations: PET (polyester); PEN polyester; Nylon 6,6; PCT polyester; Polypropylene (PP); PBT polyester; Nylon 6; co-polyamides; Polylactic acid (PLA); polystyrene; Acetal; polyurethane (PU); Soluble co polyester; HDPE, LLDPE.

The UMF in accordance with this invention are characterized in that they are comprised of hydrophobic materials which can have a lower hydrophobic reading than polypropylene. Such reference, therefore, includes classically, materials that would ordinarily be classified as hydrophobic, however, they are less hydrophobic than the hydrophobic polymers from which they are made due to the high surface area they obtain in the co-extrusion process.

As stated above, preferred for use in the UMF of the present invention is a combination of polyester (PET) and nylon (PA) fiber.

The term microdenier as it relates to synthetic fibers refers to synthetic fibers with denier per filament (dpf) of less than one. An example would be a 150 denier polyester fiber that was made from 150 individual filaments. This is commonly used today in almost all nylon and polyester garments to enhance garment performance. The scope of this invention includes the use of yarns comprising microfibers in conjunction with yarn comprising PP fibers which will produce a garment that is effective but less effective than when PP yarns are used in conjunction with yarns comprising ultra microfibers (UMF).

Thus the present invention is directed in another aspect to a combination yarn system having enhanced thermal control properties wherein a plurality of the yarns within said system comprise polypropylene (PP) and a plurality of the yarns comprise microfibers (MF) and wherein the ratio of said yarns to each other within said system range from between 97% PP and 3% MF to 97% MF and 3% PP.

Since it is also possible, based on the teachings of the present specification, to substitute PP with micro-denier yarns made from PET or polyaramide (PA) and to produce a garment that is effective, although it is possible that the same is less effective than those produced with PP yarns, the present invention also includes within its scope a combination yarn system having enhanced thermal regulating properties wherein a plurality of the yarns within said system comprise yarns made from fibers selected from PET and PA and a plurality of the yarns comprise ultra microfibers (UMF) and wherein the ratio of said yarns to each other within said system range from between 97% PET or PA and 3% UMF to 97% UMF and 3% PET or PA. In some embodiments, the thermal control combination yarn system comprises micro-denier yarns made form polyester or polyaramide, having a preponderance of such micro-denier yarns being surface-exposed on a first surface of said system and a second plurality of yarns within said system comprising ultra microfibers (UMF) comprised of a relatively low hydrophobic material as compared to the micro-denier yarns, and the ratio of the micro-denier yarns to the UMF are from between 97% PET or PA and 3% UMF to 97% UMF and 3% PET or PA.

The combination yarn systems of the present invention are also contemplated to include a 1 denier per filament, or other denier per filament values of polyester (PET) or nylon (PA) yarn UMF of polypropylene (PP) yarn. Such arrangement, however, will yield in some embodiments, a garment that is less effective than those produced whereby the polypropylene yarns are most proximal to a site away from which the mobilization of water is desired, and the UMF are located distal to the polypropylene yarn.

The term Ultra microfibers (UMF) as used herein, relates to fibers having no less than 10 filaments per denier and usually refers to fibers composed of filaments which have been chemically split to a further reduction in size or extruded in such a way that the filaments are smaller in thickness than 1 denier per filament. A commonly used fiber would be a 160 denier fiber which is made up of 72 filaments which have each been divided into 16 sub-filaments. FIG. 1 shows a cross section of an ultra micro-fiber (UMF). The exemplified material is comprised of 100% cotton and at time 1, there is an absorption of dye of approximately 1 cm, which is essentially immediate. FIG. 2 demonstrates a UMF fiber comprised of 100% polyester at time 0, showing absorption of the dye of approximately 1 cm, with essentially immediate absorption, where the fabric further comprises a surfactant to neutralize hydrophobic quality of the polyester. FIG. 3 shows a side view of a chemically split fiber comprised of polypropylene (PP)/UMF showing the stain present on the PP side indicating no absorption of dye on the UMF side. No surfactant was present on this sample and the fabric was highly hydrophobic. FIG. 4 shows a cross section of an orderly fiber in the UMF configuration comprised of PP/UMF. The stain is indicative of absorption on UMF side, showing an essentially immediate absorption of dye of approximately 2 cm. No surfactant was present and the fabric is still hydrophobic yet nonetheless absorbs the stain due to the high surface area of the UMF in the fabric.

There is more than one method for the production of these ultra microfibers which is known to people familiar in the art. In addition, a variety of almost any combination of extruded polymers can be used to obtain the effect. Common names to describe the UMF production are "Islands-In-The-Sea" or "Splittable Pie" systems which ultimately produces the desired effect in the fibers.

Figure 5:
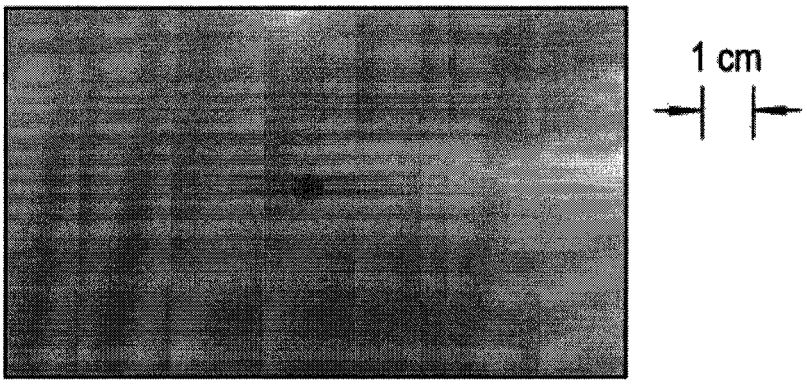
FIG. 5 is a photograph of the PP/UMF combination fabric with a drop of dye placed on the side of the UMF at 30 seconds. The absorption of the dye is at approximately 4 cm in 30 seconds.

A typical cross-section of an Island-In-The-Sea fiber is seen in FIG. 5. This particular fiber contains 64 individual small fibers of one polymer spun inside of a matrix, or sea, of another fiber. The fiber shown has a denier of approximately three but is divided into 64 sub-filaments. The fabric is comprised of PP/UMF and the stain pattern on the UMF side of the fabric is shown. Absorption of the dye of a front of approximately 4 cm. in 30 seconds was found. The fabric contained no surfactant.

Figure 6:
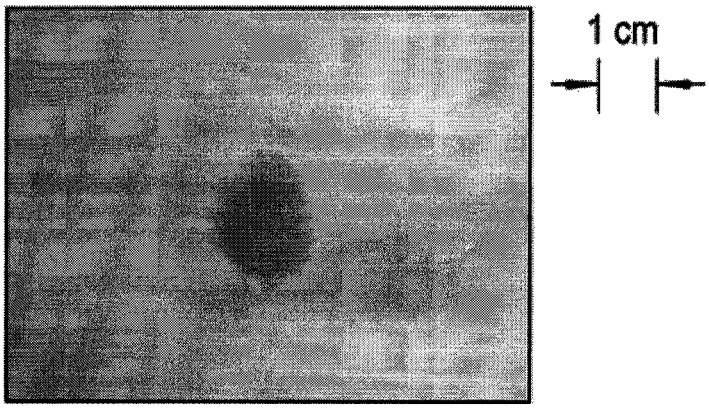
FIG. 6 is a photograph of a 100% cotton after 1 minute. The absorption of the dye is approximately 2 cm.

The islands compose approximately 80% of the fiber and the sea is approximately 20% of the fiber. These microdenier filaments are developed when the sea polymer is dissolved after the yarn or fabric has been woven or knit. A chemically split single filament demonstrating ultra microfiber (UMF) configuration is shown in FIG. 6. The material shown is comprised of 100% cotton having an absorption of dye of approximately 2 cm in 1 minute, with the stain size being essentially identical on either face of the fabric.

Figure 7:
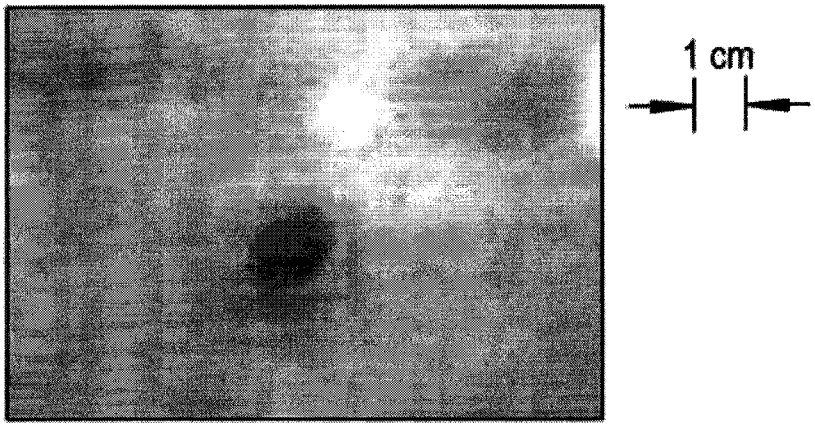
FIG. 7 is a photograph of 100% polyester fabric. The size of the stain is approximately 1.75 cm after 1 minute. It should be noted that the stain on the reverse side is exactly the same as the size of the stain on the face of the fabric.

Splittable Pies is another name for a way to produce ultra microdenier (UMF). Using this concept, a 2 to 4 dpf bicomponent pie yarn is again spun and processed with standard techniques. Once in fabric form, a mild caustic solution is applied to the fabric causing the individual fibers to split apart from the main fiber. If a 32 segment pie of nylon/polyester as shown in FIG. 7 is used, the final dpf of the fibers are in the range of 0.1. In this aspect, a 100% polyester material is shown, having a dye absorption of approximately 1.75 cm. in 1 minute. The size of the stain on either fabric face was essentially the same.

Brushing and other type of finishing techniques can be used to enhance the effects.

The polyester/polypropylene fiber pies shown stay together during spinning but come apart with various types of down-stream processing. The yarn shown in the photomicrographs in FIG. 7 consists of 198 three-denier filaments before drawing.

With the use of modern bicomponent technology, microdenier fibers with a dpf of less than 0.2 can now be produced and processed economically and in large quantities. The industry is no longer limited in fiber dpf to the lowest homopolymer denier that can be spun or processed into fabric with reasonable yields.

According to the present invention polypropylene (PP) contributes to the yarn of the present invention and to the textiles and garments made therefrom, the following properties:

- Low moisture absorption—due to the high amount of crystallization of PP the polymer imparts a very high hydrophobic quality to the fiber i.e. more than polyester and nylon which are considered hydrophobic themselves. This extreme hydrophobic quality forces the movement of water along its surface (wick action). This movement is necessary to force the movement of water in adjacent UMF which will ultimately thin out the layer of absorbed water as much as possible and as quickly as possible to facilitate its evaporation and thus reduce the surface temperature of the substrate.
- Lowest static component of any man-made fiber—due to this quality there is almost uninhibited movement of the absorbed water. This quality is necessary to assist in the movement of the water in the adjacent UMF.
- Good washability, quick drying, unique wicking (moisture transport)—due to this quality the fabric will dry much more quickly than a UMF fabric alone According to the present invention UMF contribute to the yarn of the present invention and to the textiles and garments made therefrom, the following properties:

High moisture gathering—due to the high surface area, these fibers will gather water through a capillary action. This water will ultimately settle within the micro-cracks created by the splitting of the UMF.

Softness—this quality will mask the stiffness of the PP fibers.

Elongation—this quality is necessary to make a normal textile fabric which is not a quality of PP.

According to the present invention it has now been discovered that the unique combination of the present invention creates a synergistic interaction of adhesion, cohesion, and capillary action as described hereinafter.

Capillary action is the tendency of a liquid to rise in narrow tubes or to be drawn into small openings such as those between grains of a rock. Capillary action, also known as capillarity, is a result of the intermolecular attraction within the liquid and solid materials. A familiar example of capillary action is the tendency of a dry paper towel to absorb a liquid by drawing it into the narrow openings between the fibers.

The mutual attractive force that exists between like molecules of a particular liquid is called cohesion. This force is responsible for holding a raindrop together as a single unit. Cohesion produces the phenomenon known as surface tension, which may allow objects that are more dense than the liquid to be supported on the surface of the liquid without sinking. When an attractive force exists between two unlike materials, such as a liquid and a solid container, the attractive force is known as adhesion. Adhesion is the force that causes water to stick to the inside of a glass. If the adhesive force between the liquid and solid is greater than the cohesive force within the liquid, the liquid is said to wet the surface and the surface of the liquid near the edge of the container will curve upward. In cases where the cohesive force is greater than adhesion, the liquid is said to be non-wetting and the liquid surface will curve downward near the edge of the container.

The combination of the adhesive forces and the surface tension that arises from cohesion produces the characteristic upward curve in a wetting fluid. Capillarity is the result of cohesion of water molecules and adhesion of those molecules to the solid material forming the void. As the edges of the container are brought closer together, such as in a very narrow tube, the interaction of these phenomena causes the liquid to be drawn upward in the tube. The more narrow the tube, the greater the rise of the liquid. Greater surface tension and increased ratio of adhesion to cohesion also result in greater rise. However, increased density of the liquid will cause it to rise to a lesser degree.

The force with which water is held by capillary action varies with the quantity of water being held. Water entering a natural void, such as a pore within the soil, forms a film on the surface of the material surrounding the pore. The adhesion of the water molecules nearest the solid material is greatest. As water is added to the pore, the thickness of the film increases, the capillary force is reduced in magnitude, and water molecules on the outer portion of the film may begin to flow under the influence of gravity. As more water enters the pore the capillary force is reduced to zero when the pore is saturated. The movement of groundwater through the soil zone is controlled, in part, by capillary action. The transport of fluids within plants is also an example of capillary action. As the plant releases water from its leaves, water is drawn upward from the roots to replace it.

The surface tension of water provides the necessary wall tension for the formation of bubbles with water. The tendency to minimize that wall tension pulls the bubbles into spherical shapes (LaPlace's law).

The pressure difference between the inside and outside of a bubble depends upon the surface tension and the radius of the bubble. The relationship can be obtained by visualizing the bubble as two hemispheres and noting that the internal pressure which tends to push the hemispheres apart is counteracted by the surface tension acting around the circumference of the circle.

Surface tension is responsible for the shape of liquid droplets. Although easily deformed, droplets of water tend to be pulled into a spherical shape by the cohesive forces of the surface layer. The spherical shape minimizes the necessary "wall tension" of the surface layer according to LaPlace's law.

Thus for example surface tension and adhesion determine the shape of a raindrop on a leaf. Falling drops take a variety of shapes due to oscillation and the effects of air friction. A water droplet can act as a lens and form an image as a simple magnifier.

The relatively high surface tension of water accounts for the ease with which it can be nebulized, or placed into aerosol form. Low surface tension liquids tend to evaporate quickly and are difficult to keep in an aerosol form. All liquids display surface tension to some degree. The surface tension of liquid lead is utilized to advantage in the manufacture of various sizes of lead shot. Molten lead is poured through a screen of the desired mesh size at the top of a tower. The surface tension pulls the lead into spherical balls, and it solidifies in that form before it reaches the bottom of the tower.

Figure 9:
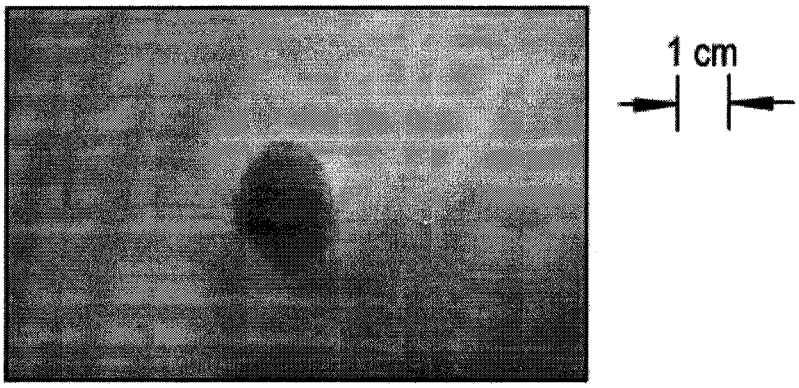
FIG. 9 is a photograph of a 100% cotton fabric after 2 minutes demonstrating a dye spread of approximately 2.5 to 3 cm.
Figure 10:
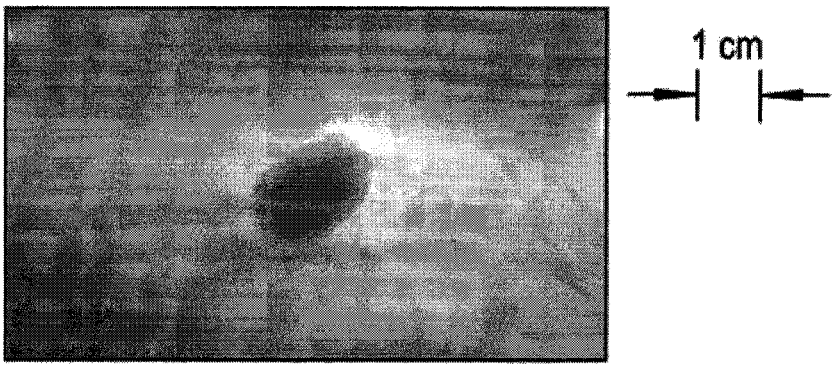
FIG. 10 is a photograph of a 100% polyester fabric after 2 minutes demonstrating a dye spread of approximately 2.5 cm.
Figure 11:
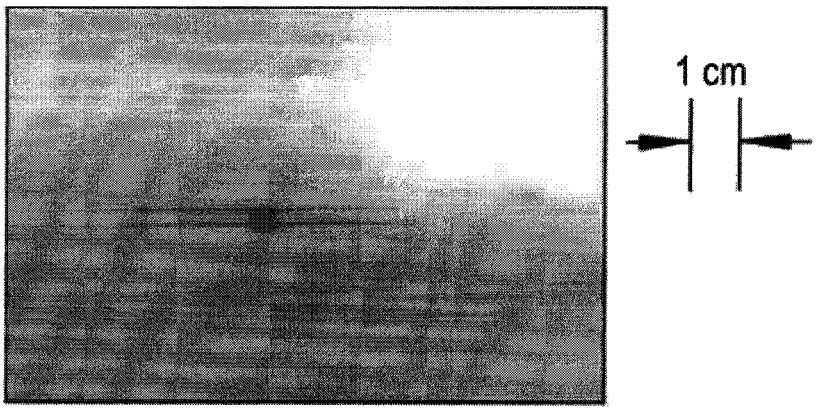
FIG. 11 is a photograph of a PP/UMF fabric with the dye on the UMF side. The spread of the dye is approximately 6.5 cm after 2 minutes. (What is seen is a low power view of a knit underside of a blended fabric wherein Black is PP and White is UMF).
Figure 12:
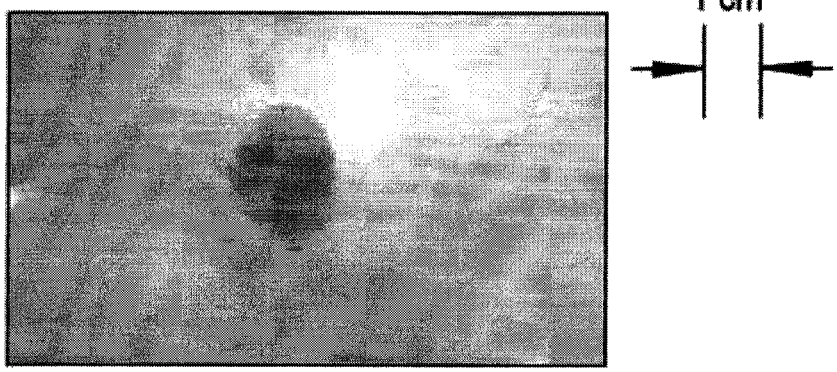
FIG. 12 is a photograph of 100% cotton fabric after 3 minutes demonstrating a dye spread of approximately 3.5 to 4 cm.-100% cotton
Figure 13:
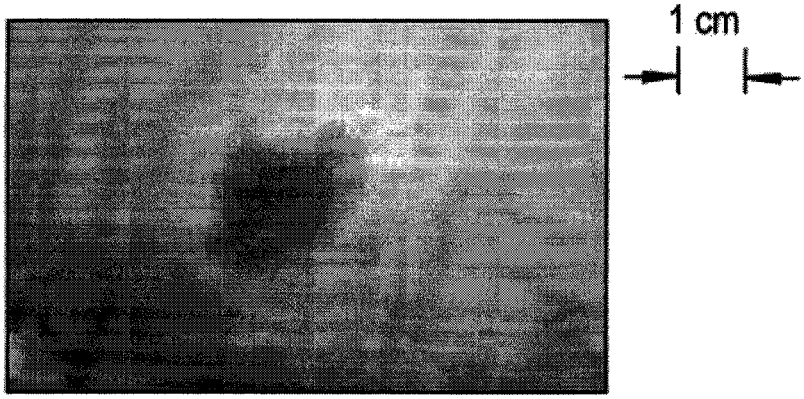
FIG. 13 is a photograph of 100% polyester fabric after 3 minutes demonstrating a dye spread of approximately 4 cm.
Figure 14:
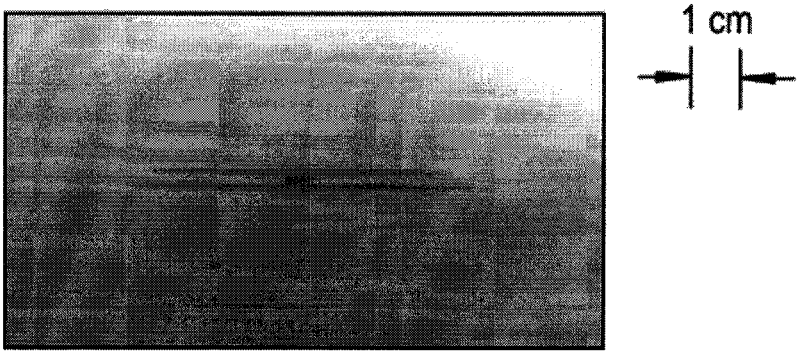
FIG. 14 is a photograph of a PP/UMF fabric with the dye on the UMF side. The spread of the dye is approximately 7.5 cm in 3 minutes.
Figure 15:
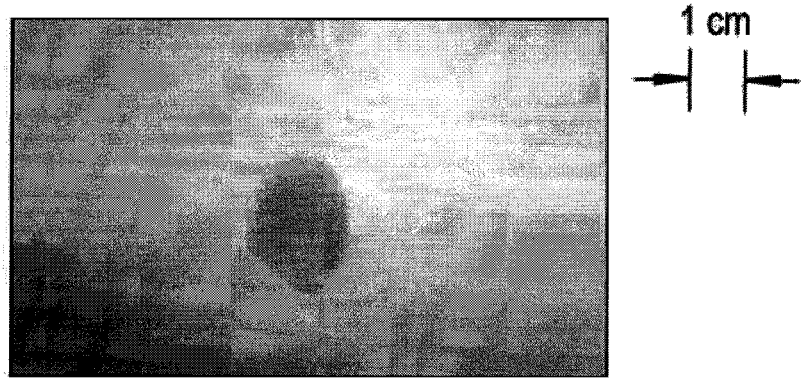
FIG. 15 is a photograph of 100% cotton fabric after 5 minutes demonstrating a dye spread of approximately 4.5 to 5 cm. The stain on the opposite side of the fabric is exactly the same as the face.
Figure 16:
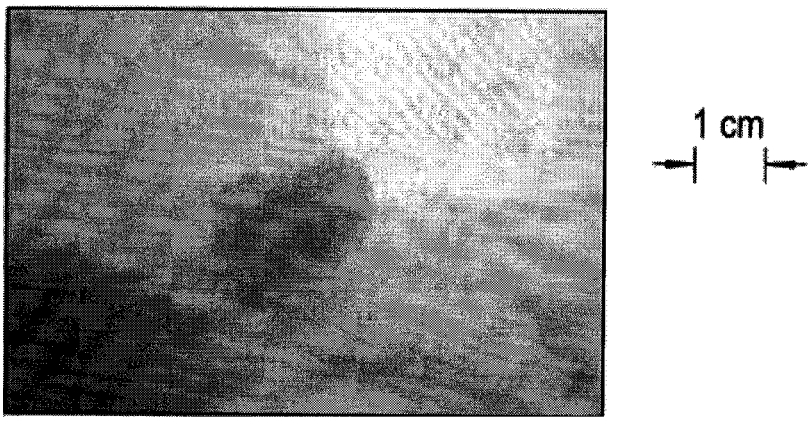
FIG. 16 is a photograph of 100% polyester fabric after 5 minutes demonstrating a dye spread of approximately 4 cm. The stain on the opposite side of the fabric is exactly the same as the face.
Figure 17:
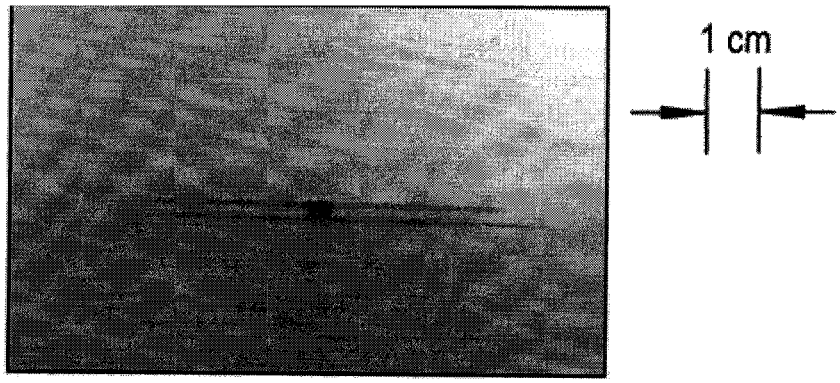
FIG. 17 is a photograph of a PP/UMF fabric with the dye on the UMF side. The spread of the dye is approximately 8.5 cm after 5 minutes. There is no dye on the opposite side of the fabric.
Figure 18:
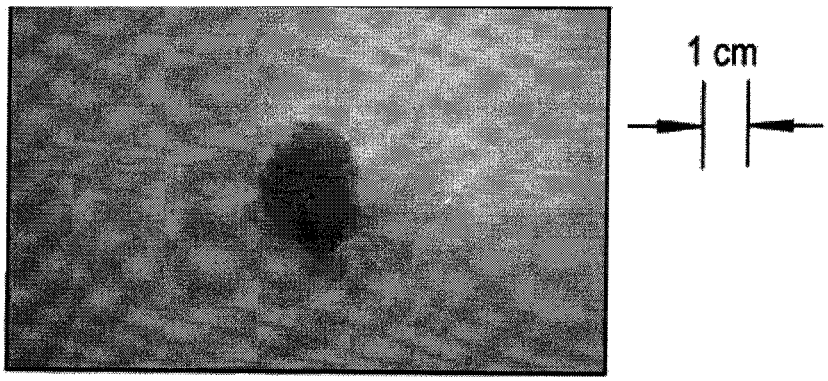
FIG. 18 is a photograph of 100% cotton fabric after 10 minutes demonstrating a dye spread of approximately 4.5 to 5 cm. The size of the stain on either face of the fabric was exactly the same.
Figure 19:
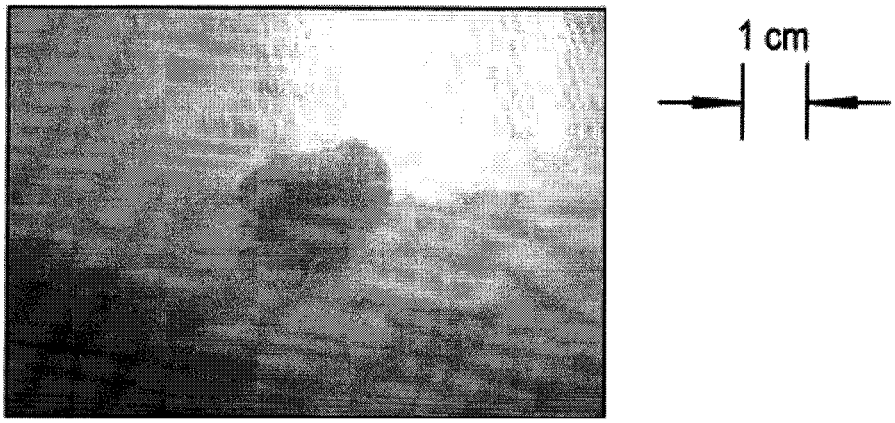
FIG. 19 is a photograph of 100% polyester fabric after 10 minutes demonstrating a dye spread of approximately 4 cm. The size of the stain on either face of the fabric was exactly the same.
Figure 20:
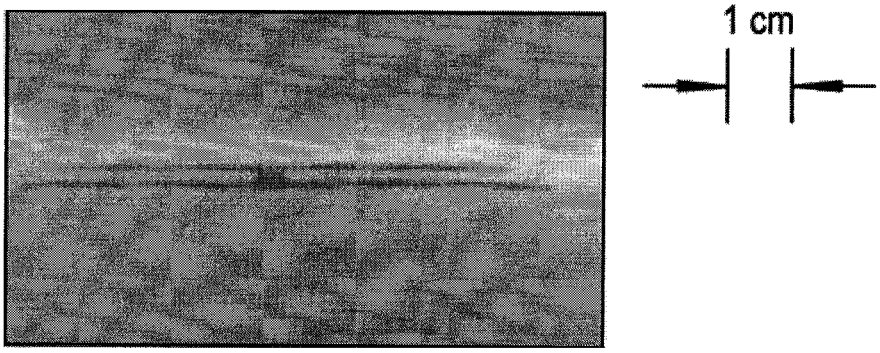
FIG. 20 is a photograph of a PP/UMF fabric with the dye on the UMF side. The spread of the dye is approximately 9.5 to 10 cm. It should be noted that there is no surfactant on the PP/UMF fabric and no appearance of the dye stuff on the opposite side of the fabric.
Figure 21:
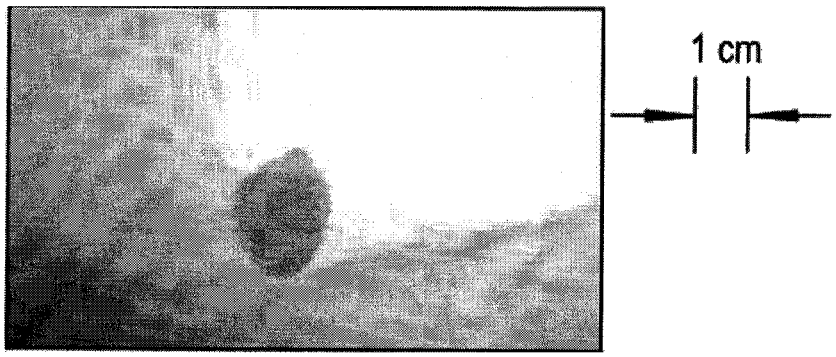
FIG. 21 is a photograph of 100% cotton fabric after 20 minutes demonstrating a dye spread of approximately 4.5 to 5 cm. The size of the stain on either face of the fabric was exactly the same.
Figure 22:
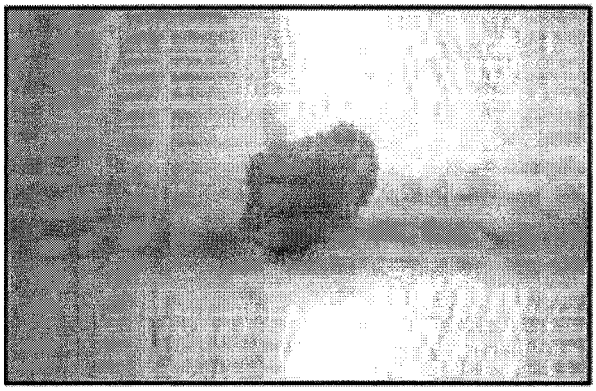
FIG. 22 is a photograph of 100% polyester fabric after 20 minutes demonstrating a dye spread of approximately 4 cm. The size of the stain on either face of the fabric was exactly the same.
Figure 23:
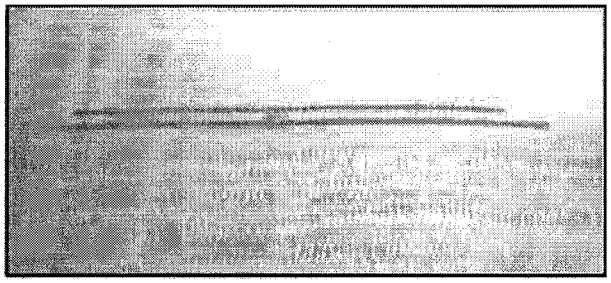
FIG. 23 is a photograph of a PP/UMF fabric with the dye apparent on the UMF side alone. The spread of the dye is approximately 11 cm.
Figure 24:
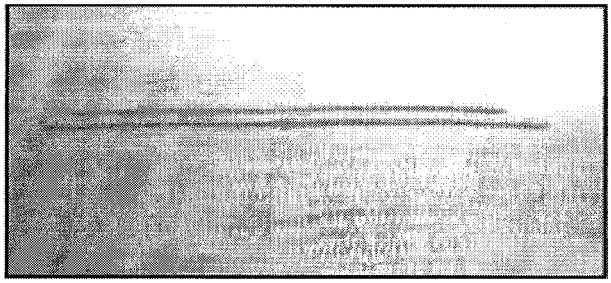
FIG. 24 is a photograph of a PP/UMF fabric being photographed from the PP side. There is no dye on the PP side but what can be seen is the reflection of the dye coming through the fabric from the UMF side. The absorption of dye was approximately of 11 cm. in 20 minutes.
Figure 25:
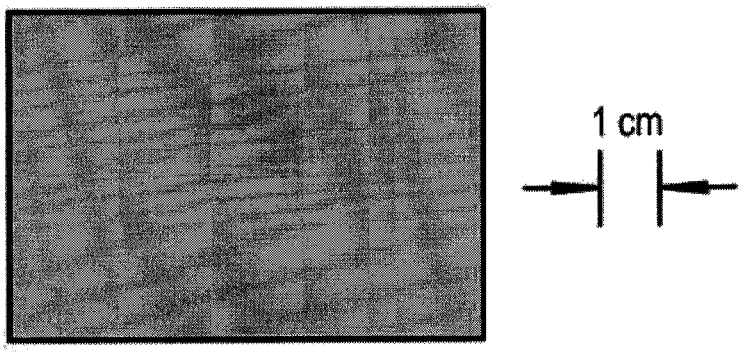
FIG. 25 is a photograph of a PP/UMF fabric being photographed at an angle from the PP side. There is no dye on the PP side which is easier to see when looked at from an angle. The reflection demonstrates a dye spread of approximately 11 cm in 20 minutes. No surfactant is on the fabric.
Figure 26:
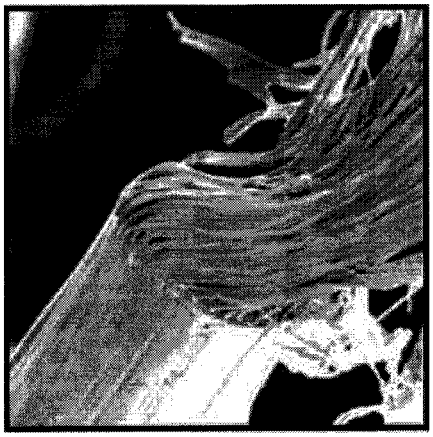
FIG. 26 is an SEM photograph of a UMF single filament demonstrating the ultra micro fiber configuration.
Figure 27:
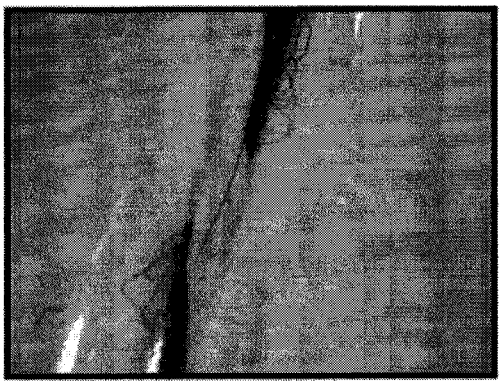
FIG. 27 is a high powered view of a plyed yarn. The black is a PP filament. The white is a UMF fiber.
Figure 28:
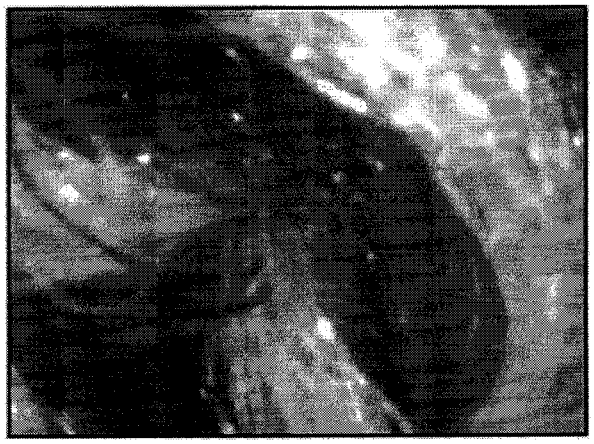
FIG. 28 is a high powered view of a blended fabric. The black is a PP yarn. The white is a UMF yarn.
Figure 29:
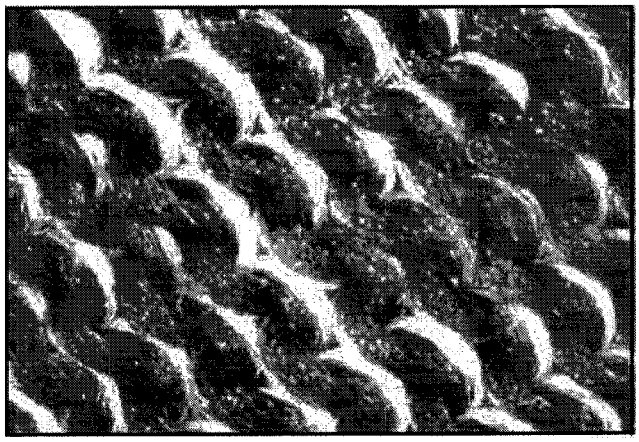
FIG. 29 is a low powered view of the top surface of a knit blended fabric. The black is a PP yarn. The white is a UMF yarn.
Figure 30:
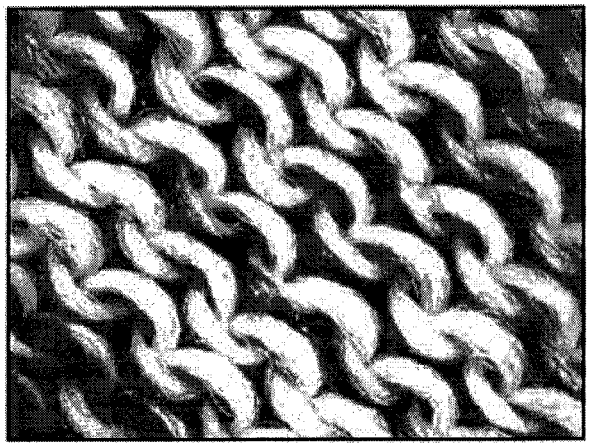
FIG. 30 is a low powered view of the underside of a knit blended fabric. The black is a PP yarn. The white is a UMF yarn.
Figure 31:
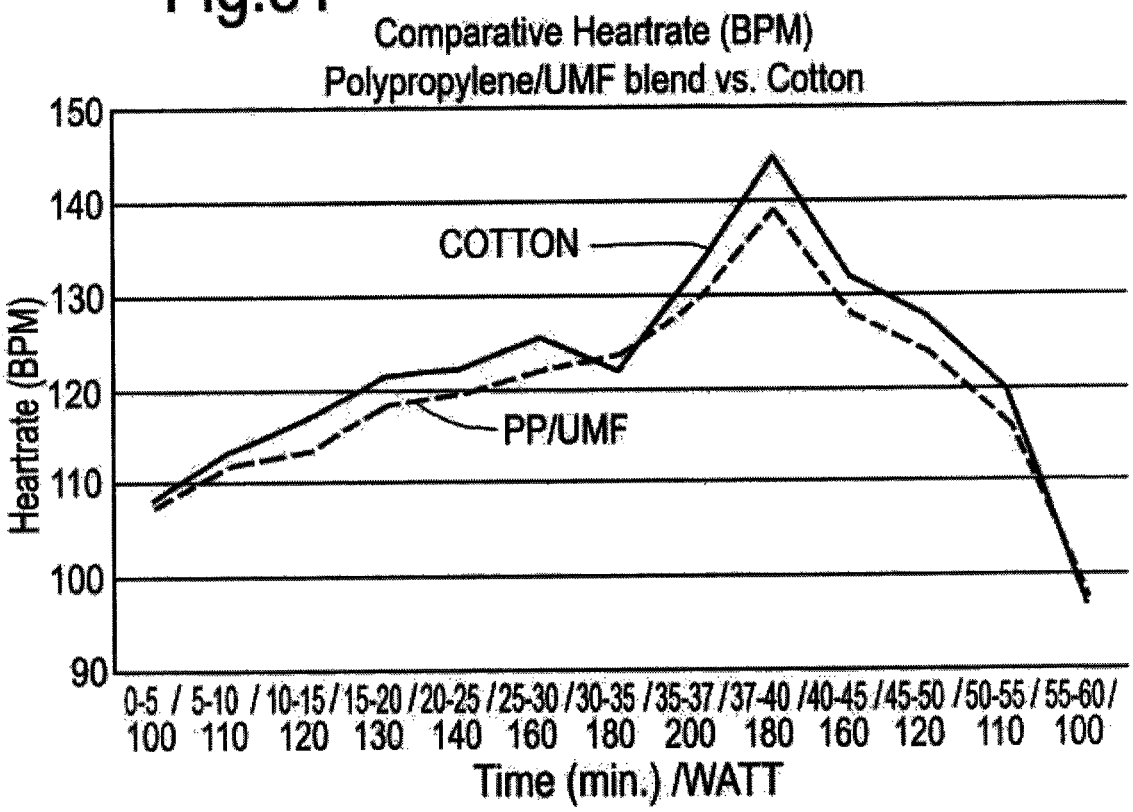
FIG. 31 is a graph demonstrating average results of 8 bicyclists wearing a 100% cotton test and then a PP/UMF shirt demonstrating the physiological differences occurring to the subjects in the experiment.

A key to the ability of the fabric produced according to the present invention to function in a surprising manner is the control of the flow of water throughout the fibers of the fabric. The effect that has been obtained is a mechanical control of the water transport along the surface and inside the micro-cracks of the two yarns which give a synergistic quality to each other when UMF yarn and PP yarn are physically in close proximity to one another (FIGS. 9 and 10). A lesser effect of water evaporation can also be obtained if the PP is blended with a micro denier yarn such as a 1 filament per denier yarn but the effect will not be as marked.

Each type of yarn fiber contributes a needed attribute to the fabric. The PP contributes the wicking and restricts the gathering of the liquid into the fabric. The UMF contributes the transport vehicle for the water as well as the ability to remove the water from the body quickly. The UMF will also increase the surface area and move the water. The water moves quicker when next to a highly hydrophobic surface which pushes the water through the fabric on the surface and in the fibers.

Thus as stated, in especially preferred embodiments of the present invention there are provide textiles, fabrics and garments incorporating a combination yarn system as defined comprising a plurality of yarns made from polypropylene (PP) and a plurality of UMF yarns, wherein a majority of said UMF containing yarns are each adjacent to at least three polypropylene containing yarns While the invention will now be further described in connection with certain particular embodiments in the following examples so that aspects thereof may be more fully understood and appreciated, it is not intended to limit the invention to these particular embodiments. On the contrary, it is intended to cover all alternatives, modifications and equivalents as may be included within the scope of the invention as defined by the appended claims. Thus, the following examples will serve to illustrate the practice of this invention, it being understood that the particulars shown are by way of example and for purposes of illustrative discussion of particular embodiments of the present invention only and are presented in the cause of providing what is believed to be the most useful and readily understood description of formulation procedures as well as of the principles and conceptual aspects of the invention.

UMF Example 1

Application in Knit Fabrics

Knit fabrics are "composed of intermeshing loops of yarn." There are two types of knits: weft knits and warp knits. While the technology described can be adapted to either type of knit, the garment used in the experiment described below was made as a weft knit.

Weft knits are characterized by the fact that each weft yarn lies more or less at right angles to the direction in which the fabric is produced. The intermeshing yarn traverses the fabric cross-wise yarns.

While the manufacturing processes are clear to those familiar with the art, the following is a brief description describing the structure and technology of knit fabrics in general.

"The width and length of knit fabrics are referred to as crosswise and lengthwise, respectively. A course is a "row of loops across the width of a fabric." A wale is a 'column of loops along the length of the fabric." Courses, therefore, lie in the crosswise direction and wales in the lengthwise direction. Unlike woven fabrics, courses and wales are not composed of different sets of yarn. Rather, courses and wales are formed by a single yarn.

In some knit fabrics—for example, the 1×1 rib fabric . . . and the double weft knits . . . —both the face and back show columns of wales. Other knit fabrics—for example, the jersey knit . . . and the tricot knit . . . —show vertical columns of loops on one side and horizontal rows of loops on the other side. The first group of fabrics may be described as having wales on both sides and the second group as having wales on one side and courses on the other. Yet other knit fabrics, such as purl fabric . . . show horizontal rows of loops on both sides. Such fabrics may be described as having courses on both side.

All knit fabrics have both wales and courses, In some knits, however, the vertical appearance of wales predominates on one or both side; in other knits the horizontal feature of courses predominates.

The basic unit of knit fabric is the loop. In weft knits, loops are called needle loops. A needle loop has a head and two legs. It also has a foot that meshes with the head of the needle loop in the course below it. The feet are usually open in weft knits the yarn does not cross over itself. The section of yarn connecting two adjacent needle loops is called the sinker.

In warp knits, the needle loop is referred to as an overlap due to the type of motion taking place to form it. The length of yarn between overlaps, the connection between stitches in consecutive courses, is called an underlap. The length and direction of the underlaps are quite important in the design of warp knits. The feet of the overlaps may be open or closed, depending on whether the yarn forming the underlaps continues in the same or opposite direction from that followed during formation of the overlap.

Each loop in a knit fabric is a stitch. A loop is always drawn through a previously formed loop . . . each stitch meshes through the previously formed loop toward the viewer, in what is called a knit stitch."

The openness or closeness of the knit as well as the stitch density can vary depending on the weight, stretch, or permeability of the fabric desired for which there is an almost infinite number of combinations.

In the case of the following, the fabrics were knit on a circular machine having 21 needles per inch in a jersey knit configuration. The weight of the fabric in the garment was 120 grams to the square meter. The garment made from the fabric was a basic t-shirt style with short sleeves. The fit of the garment was snug but not tight.

1. The subjects were all males between the ages of 27 and 31.
2. Each subject followed the same regimen of exercise.
3. Each subject used a stationary bicycle "Excite Selection from Technogym" which had a heart monitor built into the handlebar.
4. Each subject did the test a total of 6 times. 3 with a cotton shirt and 3 with a shirt made from 76% PP/24% UMF.
5. All tests were conducted in a room that was 18 C with a relative humidity of approximately 50% and were indoors.
6. No subject was on medication or had an known maladies.
7. Each session was 24 hours apart for each subject.
8. The exercise duration was 60 minutes and wattage can be seen on the chart which was the same for all subjects.

To test the efficacy of the invention an experiment was conducted. The parameters of the experiment were as follows:

In each session 6 tests were performed at least 24 hours apart, 3 while wearing a shirt made from PP/UMF and 3 while wearing a shirt made from 100% cotton. In all cases a standardized exercise was performed on the bike. The exercises of duration of 45 minutes each were divided in 8 successive periods with each having a specific output measured in Watts:

| | |
|---|---|
| 0 to 5 minutes | 100 watts |
| 5 to 10 minutes | 110 watts |
| 10 to 15 minutes | 120 watts |
| 15 to 20 minutes | 130 watts |
| 20 to 25 minutes | 140 watts |
| 25 to 30 minutes | 160 watts |
| 30 to 35 minutes | 180 watts |
| 35 to 37 minutes | 200 watts |
| 37 to 40 minutes | 180 watts |
| 40 to 45 minutes | 160 watts |
| 45 to 50 minutes | 120 watts |
| 50 to 55 minutes | 110 watts |
| 55 to 60 minutes | 100 watts |

Heartbeat levels were recorded at the end of each period so that they were measured at 5, 10, 15, 20, 25, 30, 35, 37, 40, 45, 50, 55, and 60 minutes.

Figure 32:
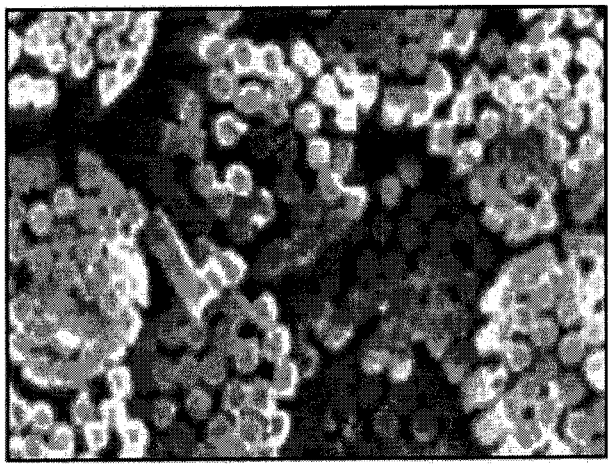
FIG. 32 is an SEM image of an Island in the Sea Ultra Microfiber.
Figure 35:
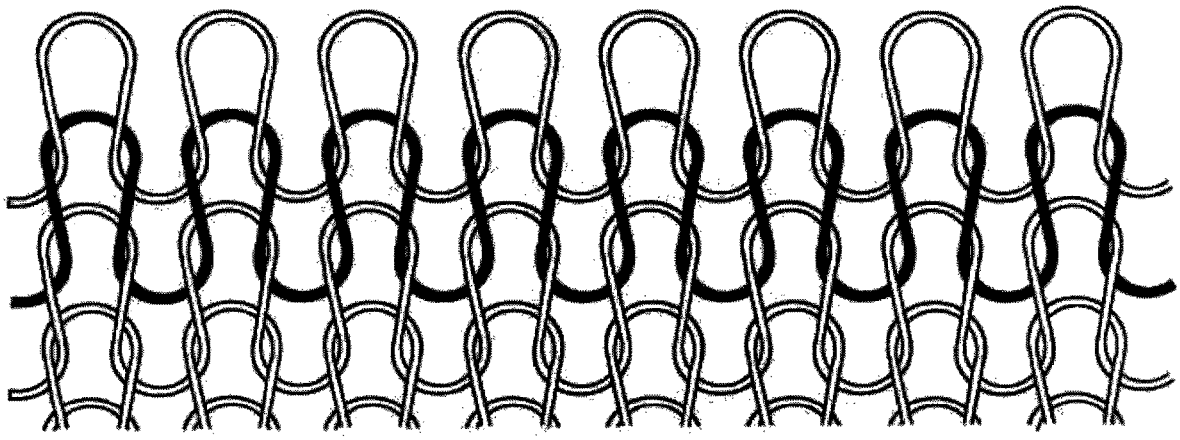
FIG. 35 is Side View of a Knit Fabric Demonstrating a Top and Bottom View of a Knit Fabric. This type of knit will appear almost the same on top and bottom but normally in this type of knit the darker color yarns would be on top which would demonstrate a wale or stripe along the length of the fabric.
Figure 36:
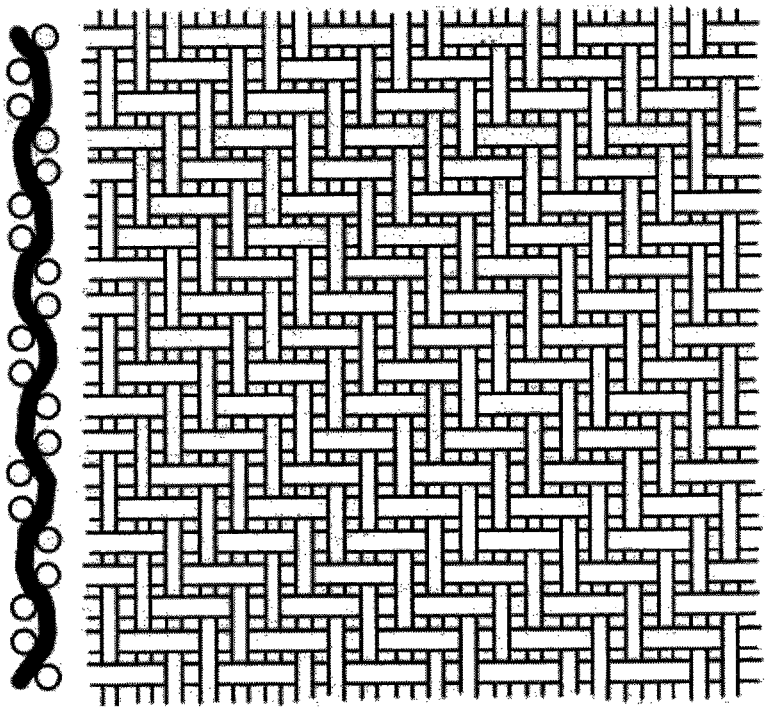
FIG. 36 is a Typical 2×1 Woven Twill. The top side of the fabric is the side shown in the Figure. The white yarns show up as the dominant yarn in the Figure and are polypropylene. The black yarn is the UMF which is the background yarn.

All data is represented as an average of the group. As shown by the data there is a surprisingly observable difference in the heart beats per minute between the subjects when they wore a cotton shirt and when they wore a PP/UMF shirt. All people who did the test wearing a PP/UMF shirt, wherein the ratio of the yarns to each other within said garment are 25% UMF and 75% PP and wherein the inner surface of said garment was characterized by a preponderance of surface exposure of the PP yarns, and UMF the outer surface of the garment was characterized by a preponderance of surface exposure of the UMF yarns which in this case were made from a polyester and a nylon in an Island in the Sea configuration as per FIG. 32, reported that subjectively they came off the exercise bicycle feeling as if the regimen of exercise was lighter than with the cotton shirt. Also, the shirts were visibly less wet with the PP/UMF than with the cotton which was soaked in perspiration.

Example 2

Application in Woven Fabrics

While many configurations of fabrics with moisture movement can be formulated in a preferred embodiment woven twill fabrics are most appropriate. Woven fabrics, unlike knit fabrics, are basically comprised of yarns running the length of the fabric (warp yarns) and the width of the fabric (weft yarns). Changes in the weave configuration can change the appearance and physical qualities of the fabric. In the case of moisture movement the twill weave is chosen because it allows for a mass producible configuration that allows each yarn to perform its specified task. A twill fabric is one in which the weave repeats on a three or more warp and filling yarns and diagonal lines are produced on the face of the fabric. Therefore, the interlacing pattern is over more than one yarn and under one or more yarns. The progression of interlacing is by one, thereby producing the diagonal line.

All twill fabrics have a series of diagonal lines, or twill lines, on at least one side of the fabric due to the interlacing of the yarns. When the twill lines appear more prominently on one side, that side is the face. When the lines are equally prominent, a convention related to direction of twill line is used to establish the face side. The diagonal lines on the face of the will fabrics may run from lower left corner of the fabrics to the upper right corner, creating a right handed twill, or from the lower rig corner to the upper left corner creating a left handed twill.

In our case, the UMF can be placed so that they are either a majority of the face or a majority of the back depending on the desired effect.

Figure 8:
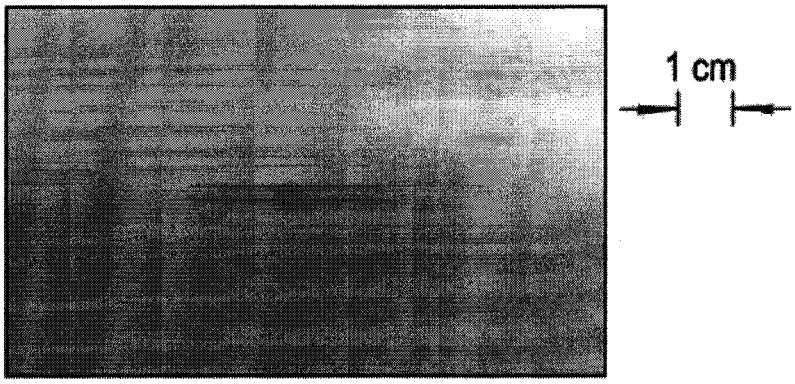
FIG. 8 is a photograph of a PP/UMF fabric with the dye on the UMF side. The spread of the dye is 5 cm after 1 minute.

In a further embodiment, two yarns of 75 denier each are twisted together. In this case, the yarns are both 75 denier. The one yarn is a 75 denier yarn with 68 filaments made from polypropylene. The second yarn in the twist is a 75 denier 36 filaments ultra micro yarn which is split 16 times yielding an effect filament count of 576. In this case, the ultra-microfiber yarn is made from a nylon core which has 16 cogs around its diameter and a polyester fiber which fits into each one of the cogs. The method for plying these yarns are those commonly used in the polymer fiber industry with a twist and an attachment to assure that the individual yarns act as a single unit yarn (FIG. 8). In this figure, a fabric comprised of 100% PP/UMF was evaluated for dye absorption, showing absorption on the UMF side of approximately 5 cm. in 1 minute.

For comparison it is to be noted that, a polyester yarn often used in many apparel applications is a 2/150/144. This means there are 2 yarns twisted together, each 150 denier in thickness and each made up of 144 filaments.

The yarns produced in example 1 can be used to produce a woven or a knit fabric by methods known per se in the art since in most cases the same denier yarns can be used in both weaving and knitting with only a slight adjustment in the twist of the finished yarn. Thus, the process of forming a fabric on a loom by interlacing the warp (lengthwise yarns) and the filling (crosswise yarns) with each other is well known. Filling is fed into the goods from cones, filling bobbins or quills which carry the filling picks through the shed of the loom. Filling may also be in shuttles loom. The three basic wears are plain, twill, and satin. All other weaves, no matter how intricate, employ one or more of these basic weaves in their composition. There are many variations to the basic principles which make different types of fabric surfaces and fabric strengths. Examples of common weaves that will be known to anyone familiar with the art are: plain, tabby, taffeta, twill, satin, basket, rib, pique, pile, jacquard, leno, etc. In this example, different yarns can be inserted in the warp or weft or the yarns can be plied together and inserted in the warp, weft, or both warp and weft. For comparison it is noted that almost any denier yarns can be used in either the warp or the weft or both. The fabric can be made with yarns that are twisted together and placed in either the warp or the weft or both however; it is also possible to obtain the effect by weaving a fabric that has either UMF in one direction of the weave and PP in the other direction. Any combination or configuration can be used to obtain the same affect.

It will be evident to those skilled in the art that the invention is not limited to the details of the foregoing illustrative examples and attached figures and that the present invention may be embodied in other specific forms without departing from the essential attributes thereof, and it is therefore desired that the present embodiments and figures be considered in all respects as illustrative and not restrictive, reference being made to the appended claims, rather than to the foregoing description, and all changes which come within the meaning and range of equivalency of the claims are therefore intended to be embraced therein.

What is claimed is:

1. A garment comprising a knit fabric comprising a thermal control combination yarn system comprising:

a first plurality of microdenier hydrophobic yarns consisting of polypropylene (PP) and having approximately 1 filament per denier, wherein a first surface of the garment consists essentially of the first plurality of yarns, which are configured to wick moisture, comprising liquid water, from the first surface; and a second plurality of yarns comprising hydrophobic ultra microfibers (UMF), which are relatively less hydrophobic than the microdenier yarns, wherein the UMF are made of sub filaments which are formed from split co-extruded filament fibers consisting of a combination of nylon and polyester and having approximately 1 filament per denier, wherein upon splitting, there are between 10 and 50 sub filaments per co-extruded filament fiber and micro-cracks have been created, wherein a second surface of the garment consists essentially of the second plurality of yarns, which are configured to disperse moisture wicked by the first plurality of yarns, wherein the first plurality of yarns is in direct contact with the second plurality of yarns, and wherein the first plurality of yarns and the second plurality of yarns are present in the system in a proportion of from 70 to 90% of the first plurality of yarns to from 10 to 30% of the second plurality of yarns, based on total yarns in the system.

2. The garment according to claim 1 for active sportswear use having enhanced cooling and thermal transition properties wherein the first surface of the garment is configured to come in contact with the skin of the wearer thereof and to wick moisture from the surface of the skin thereof, and the second surface of the garment is configured to disperse moisture wicked by the first plurality of yarns and facilitate the evaporation thereof.

3. The garment according to claim 1 having enhanced insulating and thermal transition properties wherein the second surface of the garment is configured to come in contact with the skin of the wearer thereof to spread body moisture near the skin and help create an insulating layer, and the first surface of the garment is configured to trap the insulating moisture along a surface of the second plurality of yarns.

4. The garment of claim 1, wherein the UMF of the second plurality of yarns have about 10 filaments per denier.

5. The garment of claim 1, wherein the first plurality of yarns and the second plurality of yarns have the same denier, and wherein the denier of the first plurality of yarns and the second plurality of yarns is between 15 and 400.

6. The garment of claim 1, wherein the first plurality of yarns and the second plurality of yarns are present in the system in a proportion of about 76% of the first plurality of yarns and about 24% of the second plurality of yarns, based on total yarns in the system.

7. The garment of claim 1, wherein the knit fabric is knit in a jersey configuration.

8. A garment comprising a knit fabric comprising a thermal control combination yarn system comprising:

a first plurality of microdenier hydrophobic yarns consisting of polypropylene (PP) and having approximately 1 filament per denier, wherein a first surface of the garment consists essentially of the first plurality of yarns, which are configured to wick moisture, comprising liquid water, from the first surface; and a second plurality of yarns comprising hydrophobic ultra microfibers (UMF), which are relatively less hydrophobic than the microdenier yarns, wherein the UMF are made of sub filaments which are formed from split co-extruded filament fibers consisting of a combination of nylon and polyester and having approximately 1 filament per denier, wherein upon splitting, there are between 10 and 50 sub filaments per co-extruded filament fiber and micro-cracks have been created, wherein a second surface of the garment consists essentially of the second plurality of yarns, which are configured to disperse moisture wicked by the first plurality of yarns, wherein the first plurality of yarns is in direct contact with the second plurality of yarns, and wherein the first plurality of yarns and the second plurality of yarns are present in the system in a proportion of from 70 to 90% of the first plurality of yarns to from 10 to 30% of the second plurality of yarns, based on total yarns in the system, and wherein the knit fabric is knit in a jersey configuration.

9. The garment according to claim 8 for active sportswear use having enhanced cooling and thermal transition properties wherein, the first surface of the garment is configured to come in contact with the skin of the wearer thereof and to wick moisture from the surface of the skin thereof, and the second surface of the garment is configured to disperse moisture wicked by the first plurality of yarns and facilitate the evaporation thereof.

10. The garment according to claim 8 having enhanced insulating and thermal transition properties, wherein the second surface of the garment is configured to come in contact with the skin of the wearer thereof to spread body moisture near the skin and help create an insulating layer, and the first surface of the garment is configured to trap the insulating moisture along a surface of the second plurality of yarns.

11. The garment of claim 8, wherein the UMF of the second plurality of yarns have about 10 filaments per denier.

12. The garment of claim 8, wherein the first plurality of yarns and the second plurality of yarns have the same denier, and wherein the denier of the first plurality of yarns and the second plurality of yarns is between 15 and 400.

13. The garment of claim 8, wherein the first plurality of yarns and the second plurality of yarns are present in the system in a proportion of about 76% of the first plurality of yarns and about 24% of the second plurality of yarns, based on total yarns in the system.

* * * * *